US010962920B2

(12) United States Patent
Shimizu

(10) Patent No.: US 10,962,920 B2
(45) Date of Patent: Mar. 30, 2021

(54) DEVELOPING CARTRIDGE INCLUDING DRIVE GEAR, FIRST GEAR, AND SECOND GEAR

(71) Applicant: BROTHER KOGYO KABUSHIKI KAISHA, Nagoya (JP)

(72) Inventor: Keita Shimizu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/516,940

(22) Filed: Jul. 19, 2019

(65) Prior Publication Data

US 2020/0073319 A1 Mar. 5, 2020

(30) Foreign Application Priority Data

Aug. 30, 2018 (JP) ..... JP2018-161154

(51) Int. Cl.

| | |
|---|---|
| ***G03G 21/00*** | (2006.01) |
| ***G03G 21/16*** | (2006.01) |
| ***G03G 21/18*** | (2006.01) |
| *G03G 15/08* | (2006.01) |

(52) U.S. Cl.

CPC ..... *G03G 21/1647* (2013.01); *G03G 21/1676* (2013.01); *G03G 21/186* (2013.01); *G03G 21/1857* (2013.01); *G03G 15/0865* (2013.01)

(58) Field of Classification Search

CPC ..... G03G 15/0863; G03G 15/0896; G03G 21/1647; G03G 21/1676; G03G 21/1857; G03G 21/1896; G03G 2221/163; G03G 2221/1892; G03G 21/186; G03G 21/1864

USPC ..... 399/13, 119

See application file for complete search history.

(56) References Cited

U.S. PATENT DOCUMENTS

| | | | | |
|---|---|---|---|---|
| 8,845,472 | B2 * | 9/2014 | Matsuda | F16H 57/0464 475/159 |
| 2011/0236062 | A1 | 9/2011 | Takagi | |
| 2013/0260952 | A1 * | 10/2013 | Matsuda | F16H 57/082 475/346 |
| 2017/0184999 | A1 * | 6/2017 | Jung | G03G 15/0865 |
| 2017/0269536 | A1 * | 9/2017 | Watanabe | G03G 15/757 |
| 2020/0073318 | A1 * | 3/2020 | Shimizu | G03G 21/1647 |
| 2020/0133165 | A1 * | 4/2020 | Ishida | G03G 15/0889 |

FOREIGN PATENT DOCUMENTS

| | | |
|---|---|---|
| JP | 2011-203362 A | 10/2011 |

* cited by examiner

*Primary Examiner* — Robert B Beatty
(74) *Attorney, Agent, or Firm* — Merchant & Gould P.C.

(57) ABSTRACT

A developing cartridge includes: a casing; a drive gear; a first gear; and a second gear. The casing is configured to accommodate developing agent therein. The first gear is configured to receive a driving force from the drive gear. The first gear is rotatable about a first axis extending in an axial direction in accordance with rotation of the drive gear. The first gear includes a first protrusion. the second gear is configured to receive the driving force from the drive gear. The second gear is rotatable about the first axis. the second gear includes a second protrusion. A rotational speed of the second gear is faster than a rotational speed of the first gear.

16 Claims, 14 Drawing Sheets

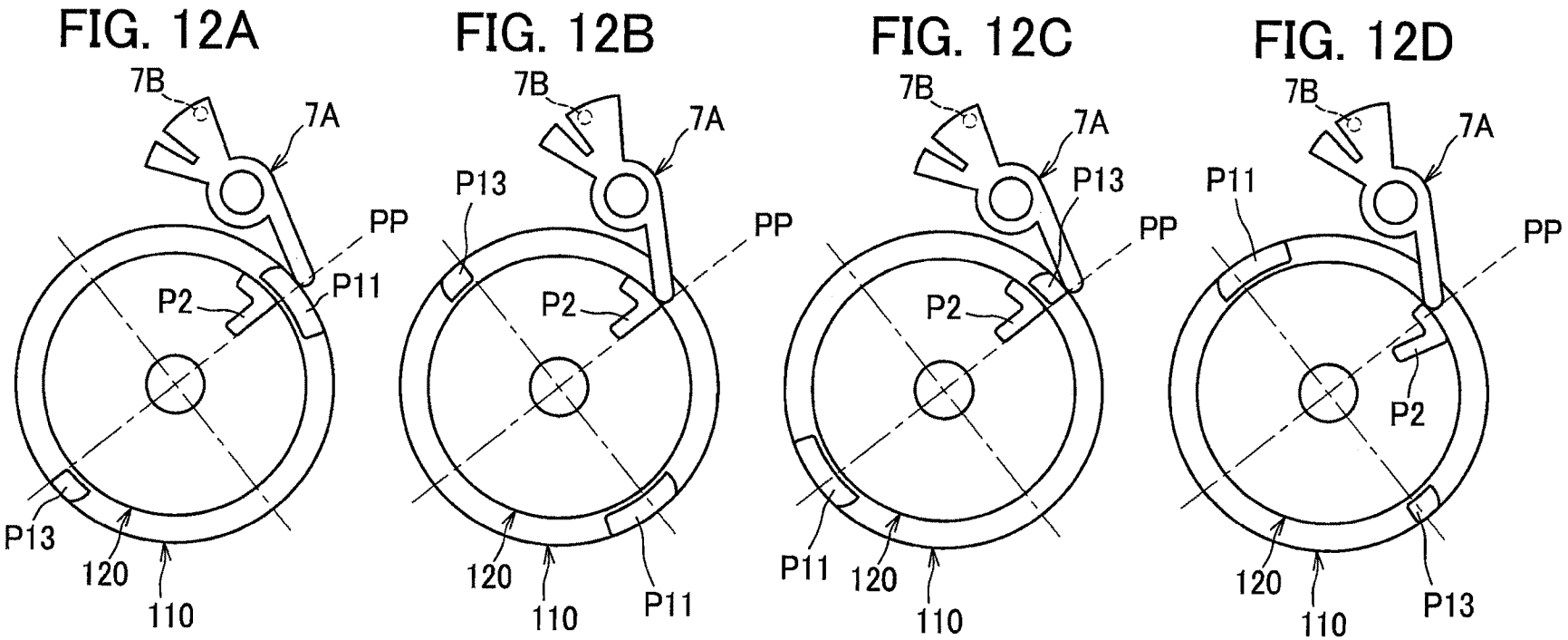
FIG. 12A
FIG. 12B
FIG. 12C
FIG. 12D
7A
7B
PP
P2
P11
P13
110
120
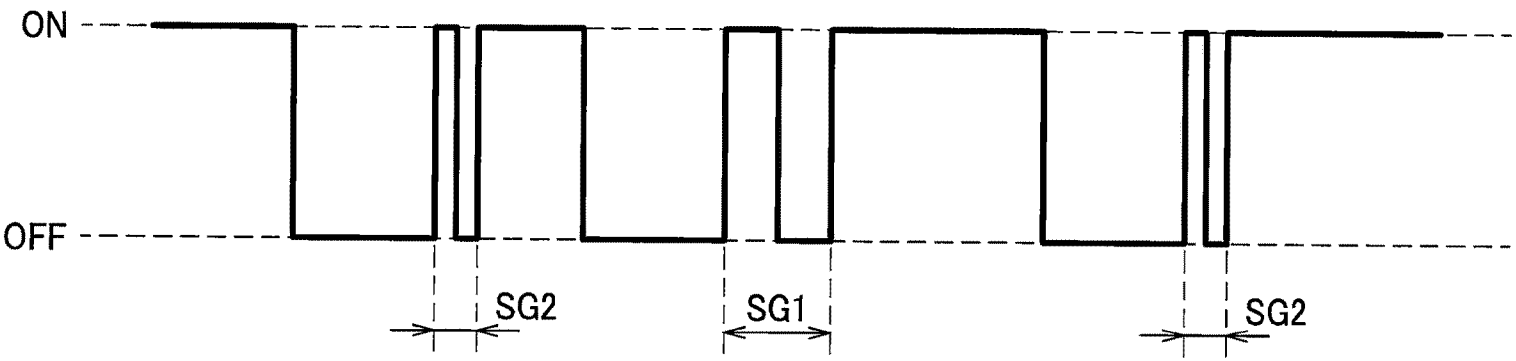
FIG. 12E
ON
OFF
SG1
SG2
SG2

DEVELOPING CARTRIDGE INCLUDING DRIVE GEAR, FIRST GEAR, AND SECOND GEAR

CROSS REFERENCE TO RELATED APPLICATION

This application claims priority from Japanese Patent Application No. 2018-161154 filed Aug. 30, 2018. The entire content of the priority application is incorporated herein by reference.

TECHNICAL FIELD

The present disclosure relates to a developing cartridge used for an image forming apparatus.

BACKGROUND

There have been known image forming apparatuses including developing cartridges. One of such image forming apparatuses is capable of determining whether or not the developing cartridge is attached or identifying a specification of the developing cartridge. For example, a prior art discloses a developing cartridge including a detection gear and protrusions movable together with rotation of the detection gear. In this configuration, the image forming apparatus detects the protrusions by means of a sensor to determine whether the developing cartridge is attached.

SUMMARY

In a case where the image forming apparatus identifies the specification of the developing cartridge by detecting the protrusions thereof, arrangement patterns of the protrusions are made different for each of a plurality of specifications. This enables the image forming apparatus to identify a developing cartridge having a particular specification from among the plurality of specifications. In recent years, there is a demand for new gear structures of the developing cartridges in response to diversification of the specifications of the developing cartridges.

In view of the foregoing, it is an object of the present disclosure to provide a developing cartridge having a new gear structure that can be used for identifying a specification of the developing cartridge.

In order to attain the above and other objects, according to one aspect, the disclosure provides a developing cartridge including: a casing; a drive gear; a first gear; and a second gear. The casing is configured to accommodate developing agent therein. The first gear is configured to receive a driving force from the drive gear. The first gear is rotatable about a first axis extending in an axial direction in accordance with rotation of the drive gear. The first gear includes a first protrusion. the second gear is configured to receive the driving force from the drive gear. The second gear is rotatable about the first axis. the second gear includes a second protrusion. A rotational speed of the second gear is faster than a rotational speed of the first gear.

According to another aspect, the disclosure provides a developing cartridge including: a casing; a drive gear; and a planetary gear mechanism. The casing is configured to accommodate developing agent therein. The planetary gear mechanism includes; a ring gear; a carrier; a planetary gear; and a sun gear. The ring gear is fixed to the casing. The ring gear has an internal tooth. The carrier meshingly engages with the drive gear and is rotatable relative to the ring gear in accordance with rotation of the drive gear. The carrier includes a first protrusion. The planetary gear is in meshing engagement with the internal tooth of the ring gear and is rotatable relative to the ring gear in accordance with rotation of the carrier. The sun gear is in meshing engagement with the planetary gear and is rotatable in accordance with rotation of the planetary gear. The sun gear includes a second protrusion. A rotational speed of the sun gear is faster than a rotational speed of the carrier.

BRIEF DESCRIPTION OF THE DRAWINGS

The particular features and advantages of the embodiment(s) as well as other objects will become apparent from the following description taken in connection with the accompanying drawings, in which:

FIGS. 12A to 12D are views illustrating operations of first protrusions of a carrier and a second protrusion of a sun gear in a developing cartridge according to a first modification and the lever of the laser printer;

FIG. 12E is a timing chart illustrating signals outputted from the sensor of the laser printer;

DETAILED DESCRIPTION

Hereinafter, a developing cartridge 10 according to one embodiment of the present disclosure will be descried in detail with reference to the accompanying drawings.

Figure 1:
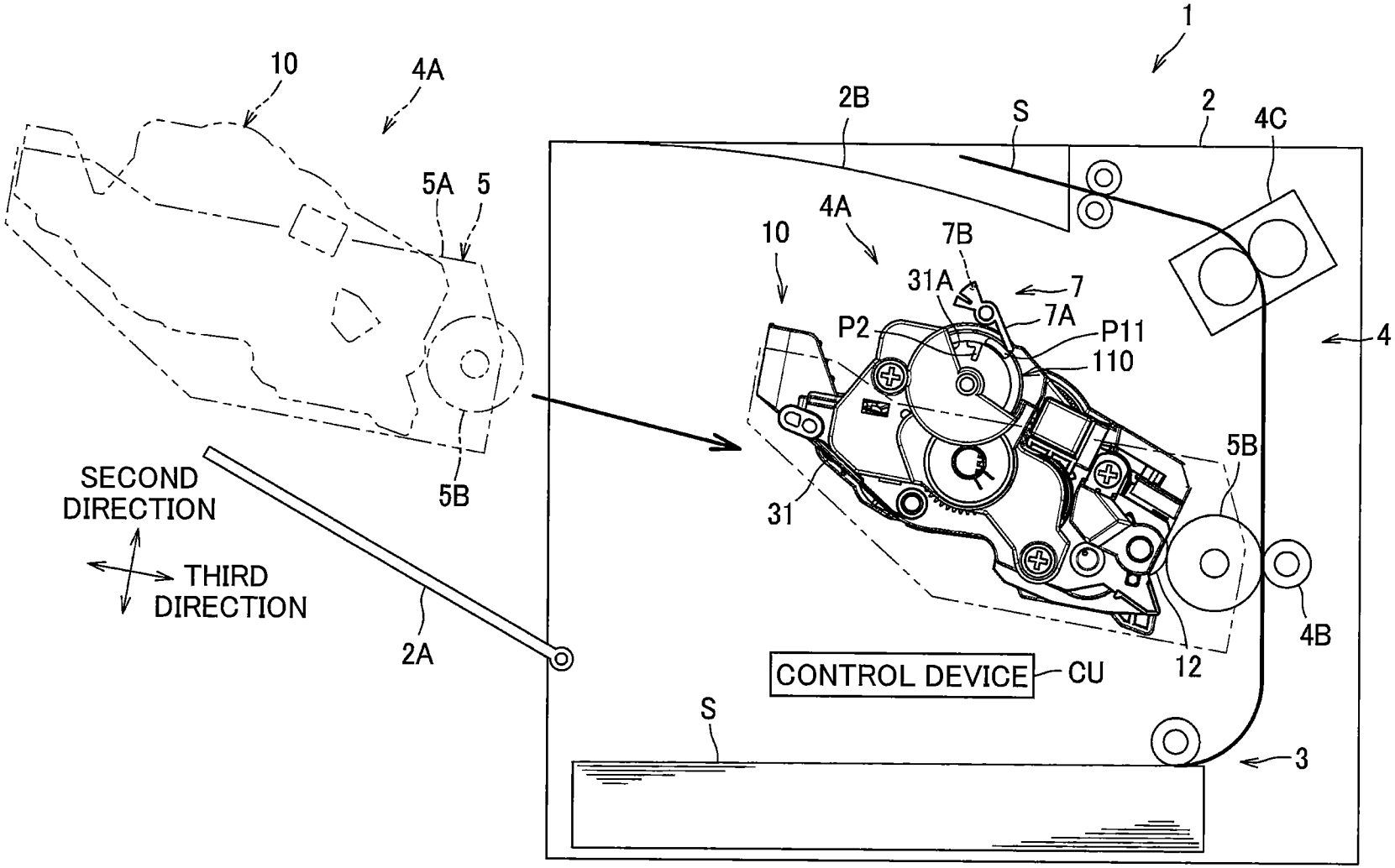
FIG. 1 is a diagram illustrating an overall configuration of a laser printer including a developing cartridge according to one embodiment of the present disclosure.

As illustrated in FIG. 1, a laser printer 1 mainly includes a main body housing 2, a sheet supply portion 3, an image forming portion 4, and a control device CU.

The main body housing 2 includes a front cover 2A, and a sheet discharge tray 2B that is positioned at an upper portion of the main body housing 2. The main body housing 2 accommodates the sheet supply portion 3 and the image forming portion 4 therein. In a state where the front cover 2A is opened, the developing cartridge 10 can be detachably attached to the main body housing 2.

The sheet supply portion 3 accommodates sheets of paper S therein. The sheet supply portion 3 supplies the sheets S one by one to the image forming portion 4.

The image forming portion 4 includes a process cartridge 4A, an exposure unit (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5, the developing cartridge 10 is attached to and detached from the main body housing 2 as the process cartridge 4A. The photosensitive cartridge 5 includes a frame 5A and a photosensitive drum 5B rotatably supported by the frame 5A.

Figure 2:
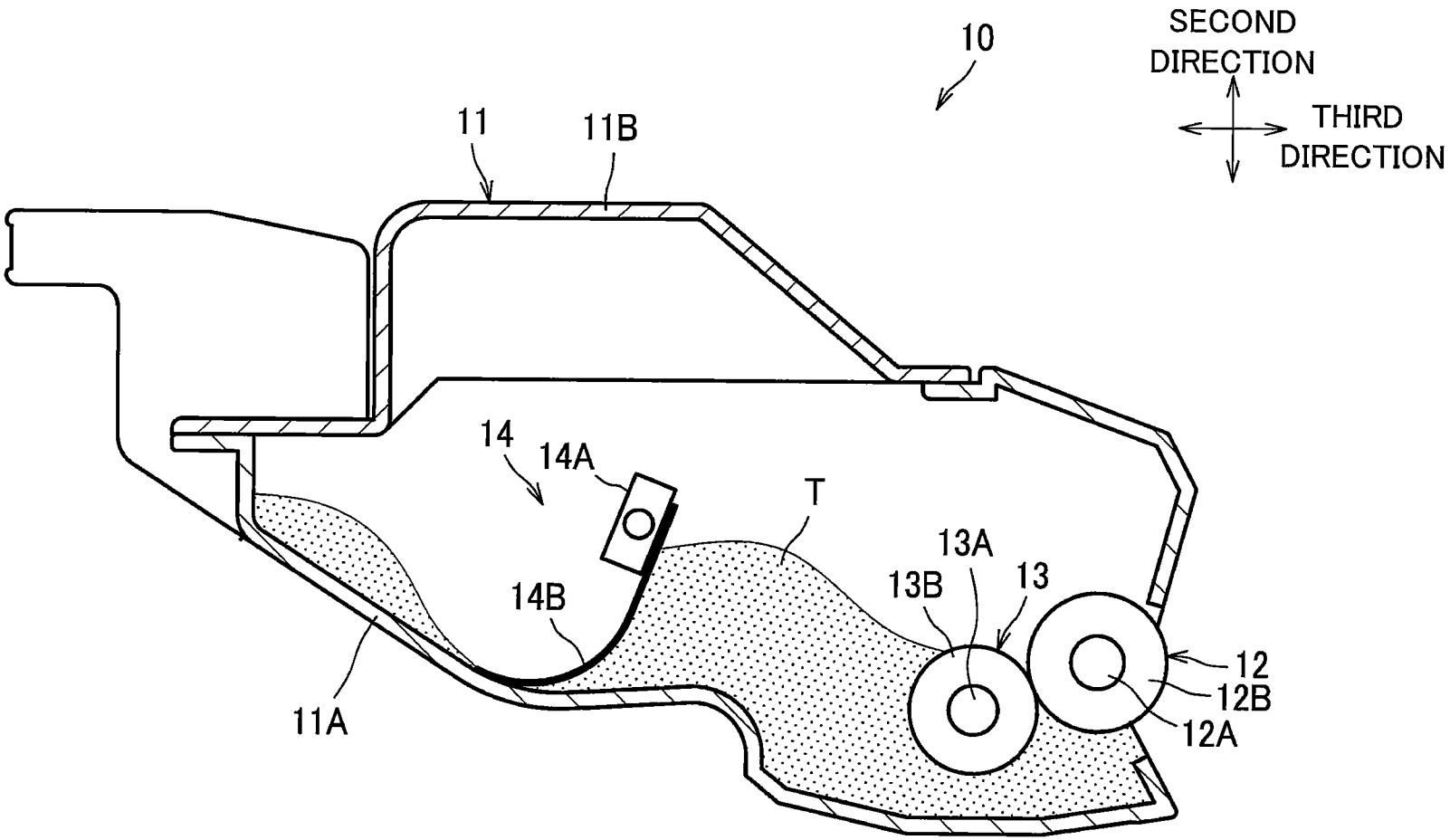
FIG. 2 is a cross-sectional view illustrating a configuration of a casing of the developing cartridge according to the embodiment.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to accommodate toner T therein. The toner T is an example of developing agent.

The developing roller 12 includes a developing roller shaft 12A extending in a first direction, and a roller portion 12B. The first direction is parallel to an axial direction of a carrier 110 (described later). Hereinafter, the first direction is also simply referred to as "axial direction". The roller portion 12B covers an outer circumferential surface of the developing roller shaft 12A. The roller portion 12B is made of, for example, electrically conductive rubber.

The developing roller 12 is rotatable about the developing roller shaft 12A. The developing roller 12 is supported by the casing 11 so as to be rotatable about the developing roller shaft 12A. That is, the roller portion 12B of the developing roller 12 is rotatable together with the developing roller shaft 12A. A developing bias is applied to the developing roller 12 by the control device CU.

The container 11A and the lid 11B of the casing 11 face each other in a second direction. The second direction crosses the first direction. Preferably, the second direction is orthogonal to the first direction. The developing roller 12 is positioned at one end portion in a third direction of the casing 11. The third direction crosses both the first direction and the second direction. Preferably, the third direction is orthogonal to both the first direction and the second direction.

The supply roller 13 includes a supply roller shaft 13A extending in the first direction, and a roller portion 13B. The roller portion 13B covers an outer circumferential surface of the supply roller shaft 13A. The roller portion 13B is made of, for example, sponge. The supply roller 13 is rotatable about the supply roller shaft 13A. That is, the roller portion 13B of the supply roller 13 is rotatable together with the supply roller shaft 13A.

The agitator 14 includes an agitator shaft 14A, and a flexible sheet 14B. The agitator shaft 14A is rotatably supported by the casing 11. The flexible sheet 14B has a base end fixed to the agitator shaft 14A and a free end configured to contact an inner surface of the casing 11. The agitator 14 is configured to agitate the toner T by rotating the flexible sheet 14B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure unit, whereby an electrostatic latent image is formed on the photosensitive drum 5B. The developing cartridge 10 supplies the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C thermally fixes the toner image transferred onto the sheet S to the sheet S. The sheet S to which the toner image has been thermally fixed is discharged onto the sheet discharge tray 2B outside the main body housing 2.

The control device CU is a device which controls the entire operation of the laser printer 1.

The laser printer 1 further includes a sensor 7. The sensor 7 is configured to detect whether or not the developing cartridge 10 is a new cartridge, or to identify a specification of the developing cartridge 10. The sensor 7 includes a lever 7A pivotably supported by the main body housing 2, and an optical sensor 7B.

The lever 7A is at a position where the lever 7A can contact first protrusions P11, P12, and P13 (described later) and a second protrusion P2 (described later). The optical sensor 7B is electrically connected to the control device CU and is configured to output a detection signal to the control device CU. The control device CU is configured to identify the specification and the like of the developing cartridge 10 on a basis of the detection signal received from the optical sensor 7B. The optical sensor 7B is configured to detect displacement of the lever 7A and to transmit the detection signal to the control device CU. More specifically, for example, a sensor unit including a light-emitting portion and a light-receiving portion is employed as the optical sensor 7B. The details will be described later.

Figure 3:
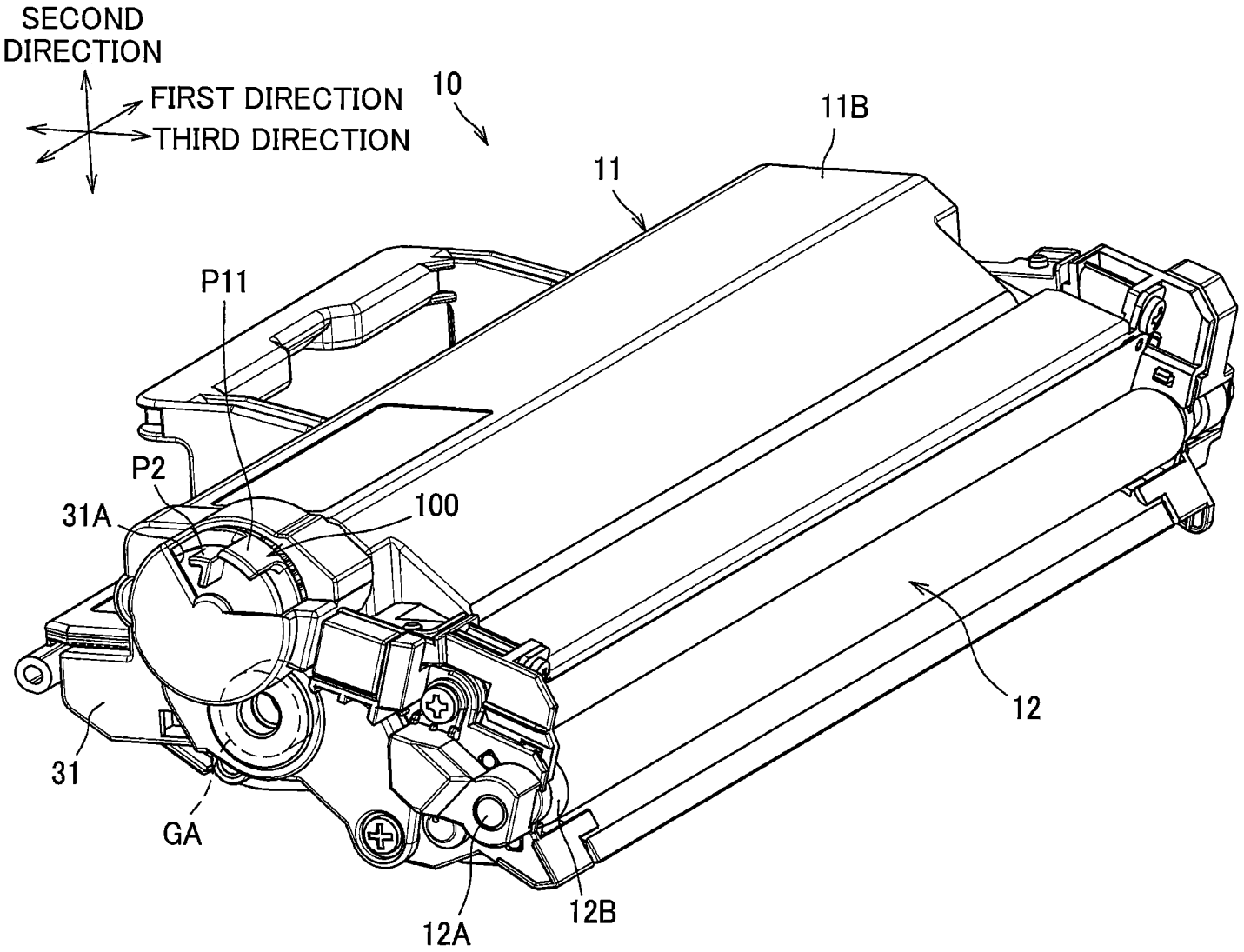
FIG. 3 is a perspective view of the developing cartridge according to the embodiment as viewed from a perspective outward thereof in a first direction.
Figure 4:
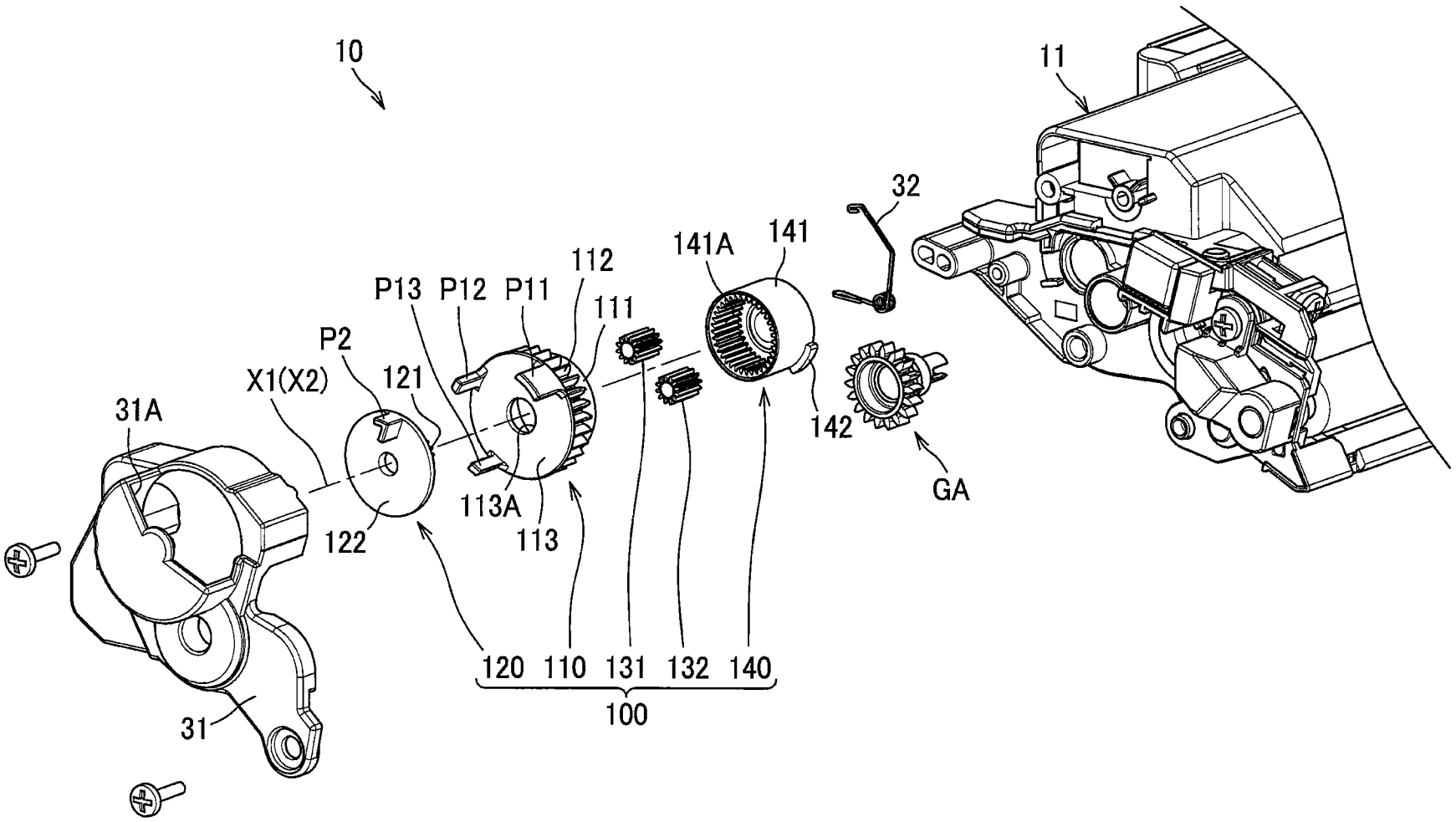
FIG. 4 is an exploded perspective view of parts in the developing cartridge according to the embodiment.

Next, a detailed configuration of the developing cartridge 10 will be described. As illustrated in FIGS. 3 and 4, the developing cartridge 10 further includes a gear cover 31, an agitator gear GA, a planetary gear mechanism 100, and a torsion spring 32 positioned at one side of the casing 11 in the first direction.

The gear cover 31 covers at least a portion of the planetary gear mechanism 100. The gear cover 31 has an opening 31A. A portion of the planetary gear mechanism 100 is exposed to an outside of the developing cartridge 10 via the opening 31A. More specifically, the three first protrusions P11, P12 and P13, and the second protrusion P2 (described later) can be exposed to the outside of the developing cartridge 10 via the opening 31A in accordance with rotation of a planetary gear 131 (described later) of the planetary gear mechanism 100.

The agitator gear GA is a drive gear for driving the planetary gear mechanism 100. The agitator gear GA is rotatable together with the agitator 14 illustrated in FIG. 2. Specifically, the agitator gear GA is fixed to one end in the first direction of the agitator shaft 14A. The main body housing 2 includes a motor (not illustrated), and the agitator shaft 14A receives driving force of the motor through another end in the first direction of the agitator shaft 14A. The agitator gear GA is an example of a drive gear.

The planetary gear mechanism 100 includes the carrier 110, a sun gear 120, the planetary gear 131, a second planetary gear 132, and a ring gear 140.

The ring gear 140 is fixed to the casing 11. Note that the ring gear 140 may be fixed so that movement of the ring gear 140 relative to the casing 11 is completely prevented, or may be fixed so that the ring gear 140 is slightly movable relative to the casing 11.

Figure 5A:
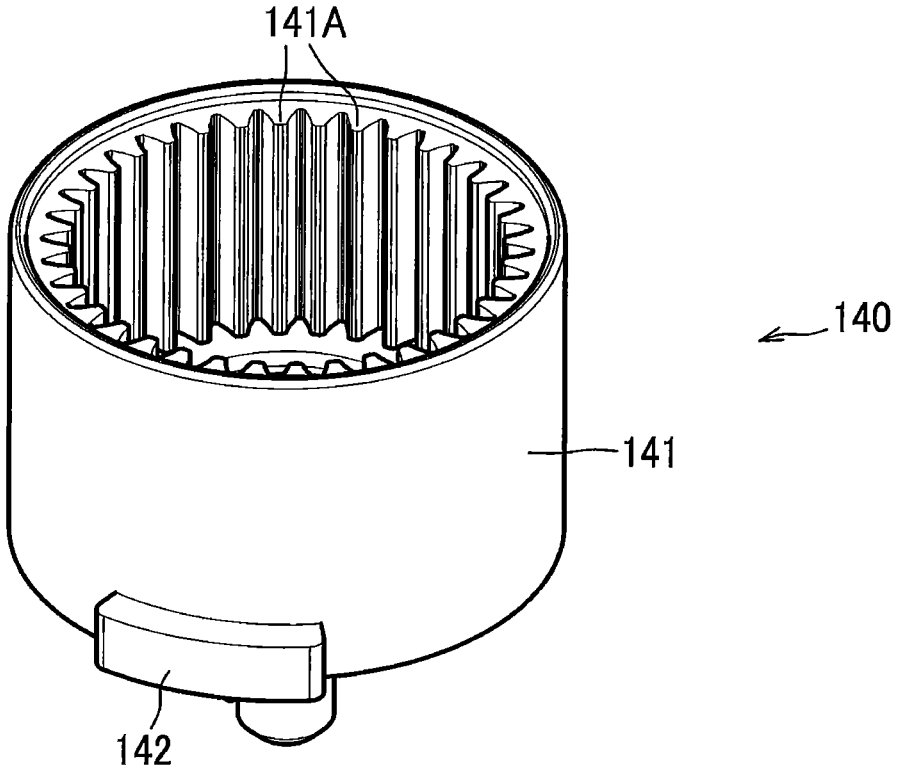
FIG. 5A is a perspective view of a ring gear in the developing cartridge according to the embodiment.
Figure 5B:
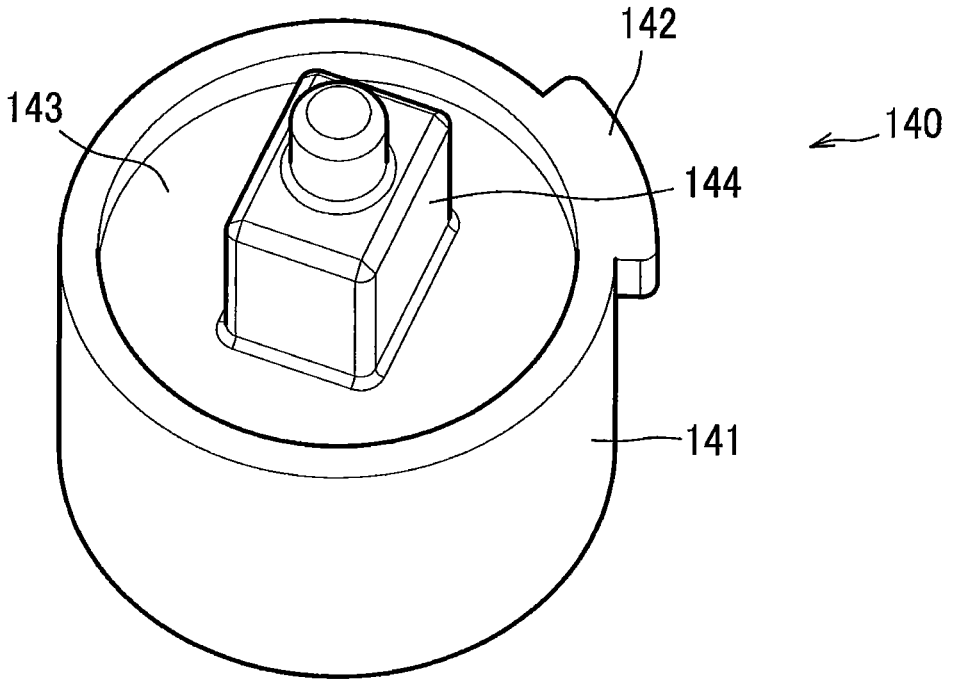
FIG. 5B is another perspective view of the ring gear in the developing cartridge according to the embodiment.

As illustrated in FIGS. 5A and 5B, the ring gear 140 includes a cylindrical portion 141, a first protruding portion 142, a bottom wall 143, and a second protruding portion 144.

The cylindrical portion 141 has a hollow-cylindrical shape, and has an inner circumferential surface. The cylindrical portion 141 has a plurality of internal teeth 141A along the inner circumferential surface thereof. Specifically, each of the plurality of internal teeth 141A protrudes radially inward of the inner circumferential surface of the cylindrical portion 141, and has a substantially triangle shape. The first protruding portion 142 protrudes from an outer circumferential surface of the cylindrical portion 141. The first protruding portion 142 is configured to contact a protrusion 111A (see FIG. 6A; described later) of the carrier 110. When the protrusion 111A comes into contact with the first protruding portion 142, the carrier 110 stops rotating.

The bottom wall 143 is positioned at one end of the cylindrical portion 141. The second protruding portion 144 is a portion fixed to the casing 11. Note that the second protruding portion 144 may be fixed to the casing 11 so that the second protruding portion 144 can slightly jounce. The second protruding portion 144 protrudes in the axial direction from the bottom wall 143.

Figure 6A:
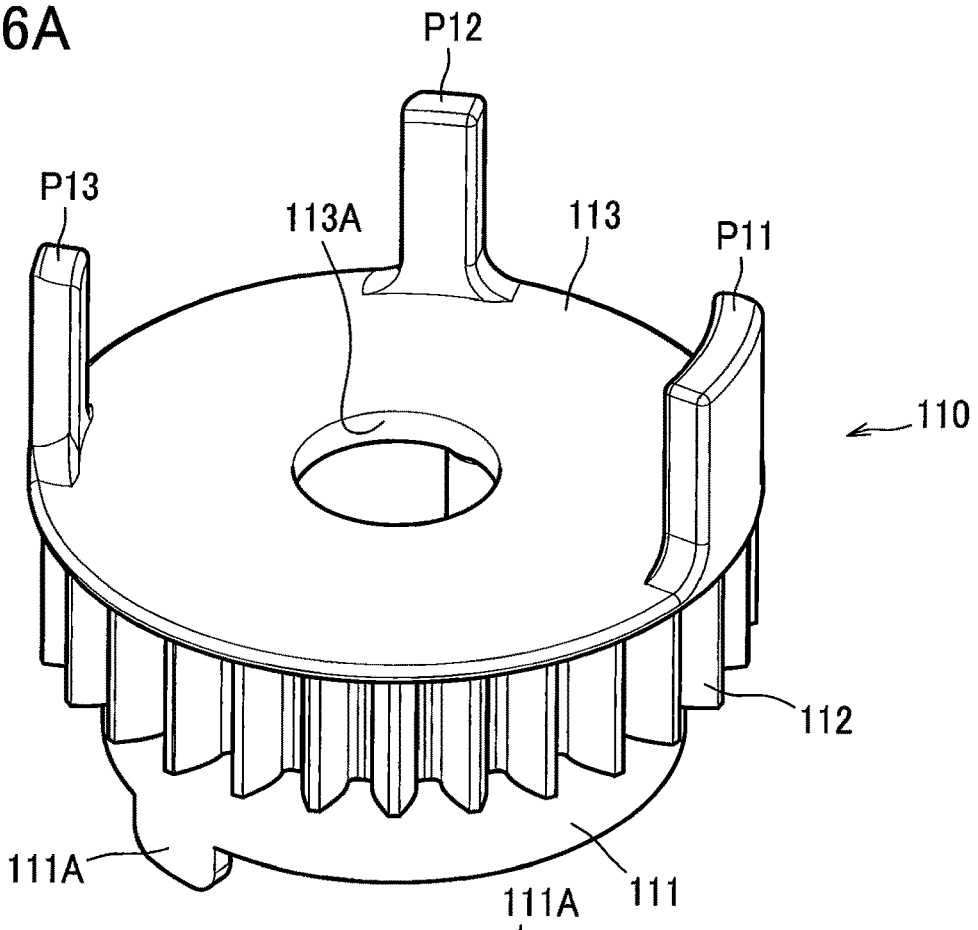
FIG. 6A is a perspective view of a carrier in the developing cartridge according to the embodiment.
Figure 6B:
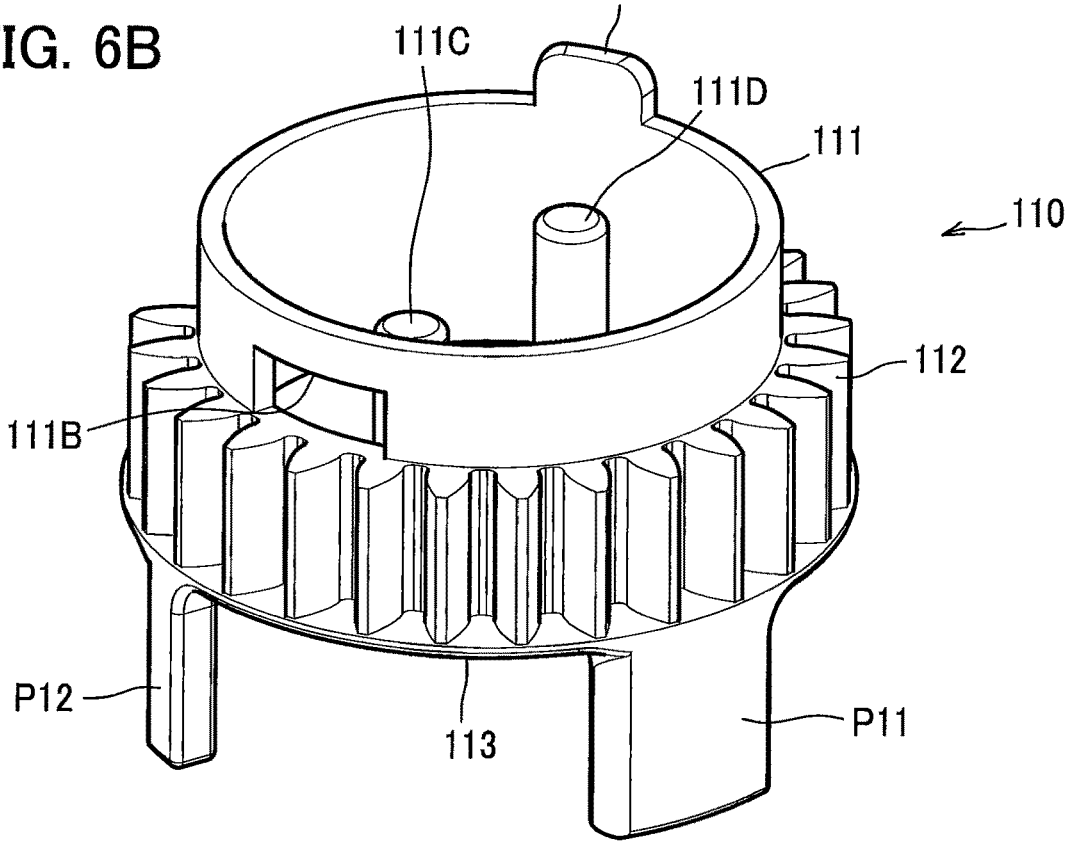
FIG. 6B is another perspective view of the carrier in the developing cartridge according to the embodiment.

FIGS. 4, 6A and 6B illustrates the carrier 110 as a first gear configured to receive driving force from the agitator gear GA. In accordance with rotation of the agitator gear GA, the carrier 110 is rotatable about a first axis X1 extending in the axial direction. Further, the carrier 110 is rotatable relative to the ring gear 140. The carrier 110 is an example of a first gear.

The carrier 110 includes a cylindrical portion 111, a plurality of gear teeth 112, a disk portion 113 having a disk-like shape, and the three protrusions P11, P12, and P13.

The plurality of gear teeth 112 can meshingly engage with the agitator gear GA. The plurality of gear teeth 112 is positioned at a portion of a periphery of the cylindrical portion 111, as illustrated in FIG. 8B. The carrier 110 is rotatable from a first position illustrated in FIG. 8B to a second position illustrated in FIG. 10A.

When the carrier 110 is at the first position, at least one of the plurality of gear teeth 112 is in meshing engagement with the agitator gear GA. When the carrier 110 is at the second position, none of the plurality of gear teeth 112 is in meshing engagement with the agitator gear GA.

As illustrated in FIGS. 4, 6A and 6B, the cylindrical portion 111 covers an outer circumferential surface of the ring gear 140 and is rotatable relative to the outer circumferential surface of the ring gear 140. The cylindrical portion 111 protrudes from the disk portion 113. Specifically, the cylindrical portion 111 protrudes from the disk portion 113 in a direction opposite to a direction in which the first protrusions P11, P12, and P13 extend.

As illustrated in FIG. 6B, the cylindrical portion 111 includes the protrusion 111A and has an engagement hole 111B.

The protrusion 111A is a portion whose movement in a rotational direction of the carrier 110 is restricted by the first protruding portion 142 (see FIG. 4) of the ring gear 140. The protrusion 111A protrudes in the axial direction from one end of the cylindrical portion 111.

The engagement hole 111B is a hole into which the torsion spring 32 (see FIG. 4) can be inserted. The engagement hole 111B is a portion of the cylindrical portion 111 positioned opposite to the disk portion 113 with respect to the gear teeth 112.

Within the cylindrical portion 111, two shafts 111C and 111D are positioned. Each of the shafts 111C and 111D protrudes from the disk portion 113. One shaft 111C is inserted into an opening of the planetary gear 131 (see FIG. 4), while the remaining shaft 111D is inserted into an opening of the second planetary gear 132 (see FIG. 4). With this configuration, the planetary gear 131 and the second planetary gear 132 are rotatable relative to the shaft 111C and the shaft 111D, respectively.

As illustrated in FIG. 6A, the disk portion 113 has a through-hole 113A at a center portion thereof. The through-hole 113A is a hole into which a gear portion 121 (see FIGS. 7A and 7B) of the sun gear 120 is inserted.

The three first protrusions P11, P12, and P13 are configured to contact the lever 7A (see FIG. 1) of the sensor 7 described above. Each of the first protrusions P11, P12, and P13 is positioned at the disk portion 113 at a position opposite to the gear teeth 112. Each of the first protrusions P11, P12, and P13 protrudes in the axial direction from an outer periphery of the disk portion 113, and has an outer peripheral surface. The outer peripheral surface of each of the first protrusions P11, P12, and P13 has a circular arc shape along the outer periphery of the disk portion 113. Each of the first protrusions P11, P12, and P13 is rotatable about the first axis X1.

Of the first protrusions P11, P12, and P13, the first protrusion P11 first contacts the lever 7A of the sensor 7. Then, secondly, the first protrusion P12 contacts the lever 7A. Thirdly, the first protrusion P13 contacts the lever 7A.

The outer peripheral surface of the first protrusion P12 has a length the same as a length of the outer peripheral surface of the first protrusion P13. The outer peripheral surface of the first protrusion P11 has a length greater than the length of the outer peripheral surface of each of the first protrusions P12 and P13.

Figure 7A:
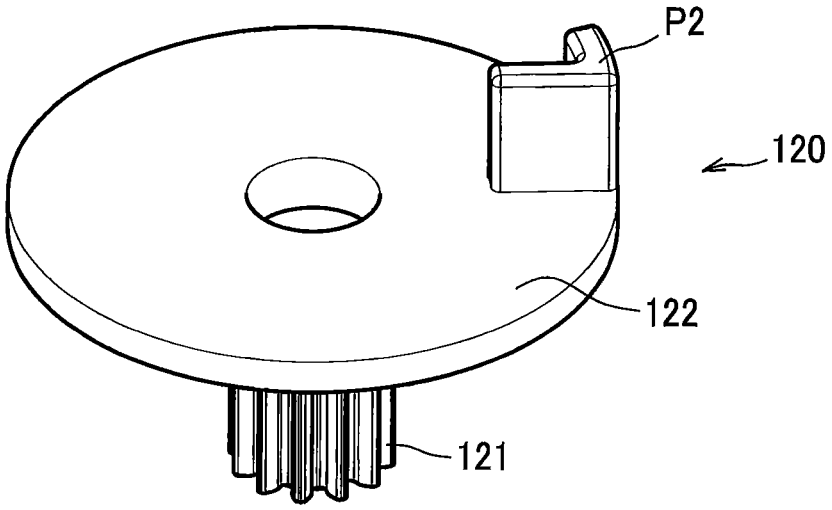
FIG. 7A is a perspective view of a sun gear in the developing cartridge according to the embodiment.
Figure 7B:
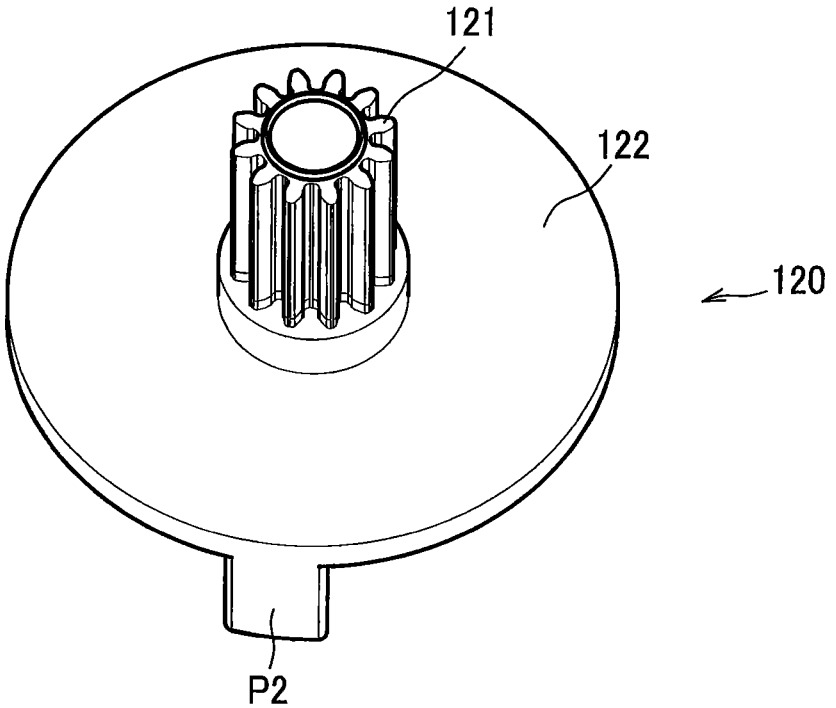
FIG. 7B is another perspective view of the sun gear in the developing cartridge according to the embodiment.

The sun gear 120 illustrated in FIGS. 4, 7A and 7B is a second gear configured to receive the driving force from the agitator gear GA. The sun gear 120 is in meshing engagement with both the planetary gear 131 and the second planetary gear 132 and is rotatable in accordance with rotations of the planetary gear 131 and the second planetary gear 132. The sun gear 120 is rotatable about a second axis X2 extending in the axial direction. In the present embodiment, the first axis X1 and the second axis X2 are coincident with each other. The sun gear 120 is an example of a second gear.

The sun gear 120 includes the gear portion 121, a disk portion 122, and the second protrusion P2.

The gear portion 121 has a plurality of gear teeth throughout an entire periphery of the gear portion 121. The gear portion 121 is inserted into the through-hole 113A of the disk portion 113, and positioned within the cylindrical portion 111 of the carrier 110. As illustrated in FIG. 8B, the gear portion 121 is positioned between the planetary gear 131 and the second planetary gear 132. Specifically, the gear portion 121 is in meshing engagement with both the planetary gear 131 and the second planetary gear 132.

The disk portion 122 has a disk-like shape, as illustrated in FIG. 4. The disk portion 122 has a diameter greater than a diameter of the gear portion 121. The sun gear 120 includes the gear portion 121 at a center portion of the disk portion 122. Further, the gear portion 121 is positioned at one surface of the disk portion 122.

The sun gear 120 includes the one second protrusion P2. The second protrusion P2 is positioned at another surface of the disk portion 122. That is, the second protrusion P2 extends in the axial direction from an outer periphery of the disk portion 122. The second protrusion P2 has a substantially L-shape. More specifically, the second protrusion P2 has a portion extending in a circumferential direction of the disk portion 122, and a portion extending in a radial direction of the disk portion 122. The second protrusion P2 has an outer peripheral surface having an arc shape along the outer periphery of the disk portion 122. The second protrusion P2 is rotatable about the first axis X1.

Figure 8A:
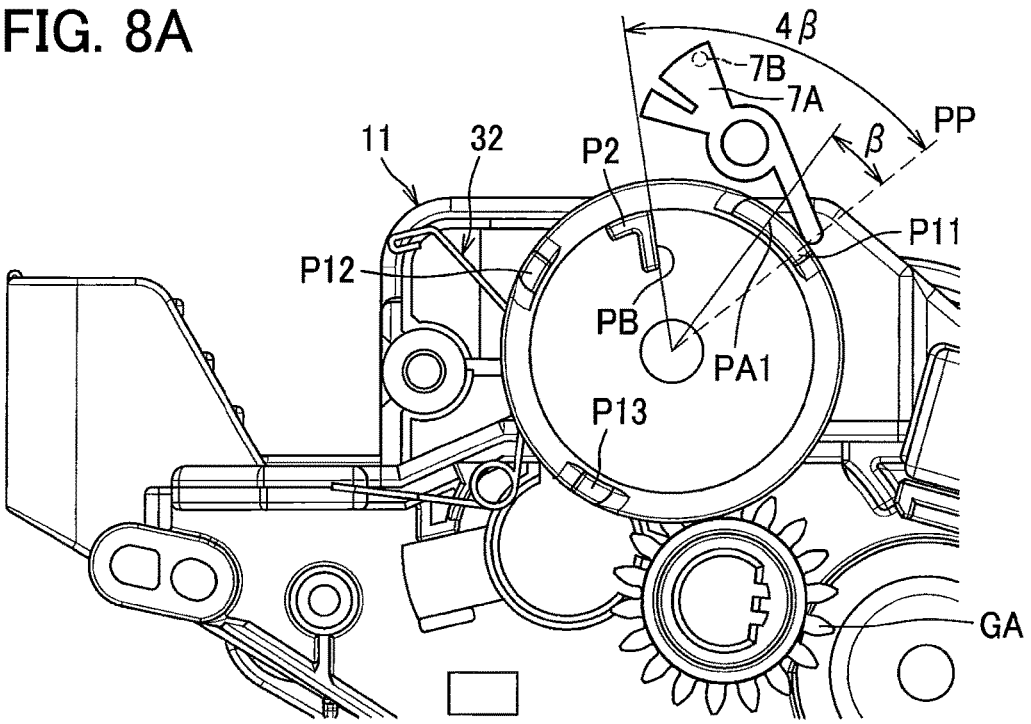
FIG. 8A is a side view illustrating relationship between first protrusions of the carrier and a second protrusion of the sun gear of the developing cartridge according to the embodiment, and illustrating a state where the carrier is in its first position.
Figure 8B:
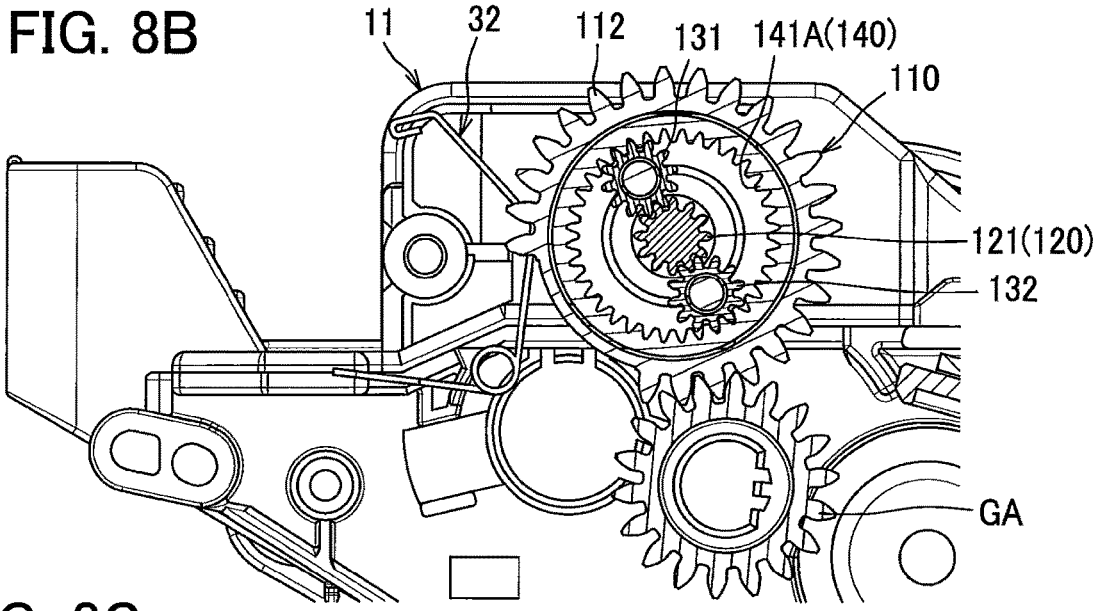
FIG. 8B is a cross-sectional view illustrating a planetary gear mechanism in the developing cartridge according to the embodiment, and illustrating a state where the carrier is in the first position.

As illustrated in FIG. 8A, the outer peripheral surface of the second protrusion P2 has a length smaller than the length of the outer peripheral surface of the first protrusion P11. Further, as illustrated in two kinds of dotted hatching areas in FIG. 9B, a rotational locus of the second protrusion P2 is positioned within a rotational locus of the first protrusions P11, P12, and P13.

As illustrated in FIG. 8B, the planetary gear 131 and the second planetary gear 132 are in meshing engagement with the plurality of internal teeth 141A, and are rotatable relative to the ring gear 140 in accordance with the rotation of the carrier 110. Further, both the planetary gear 131 and the second planetary gear 132 are in meshing engagement with the gear portion 121 of the sun gear 120, as described above.

In the planetary gear mechanism 100 configured as described above, a rotational speed of the sun gear 120 is faster than a rotational speed of the carrier 110. Specifically, the rotational speed of the sun gear 120 is four times faster than the rotational speed of the carrier 110 in the present embodiment. Further, a rotational direction of the sun gear 120 is the same as the rotational direction of the carrier 110.

Figure 8C:
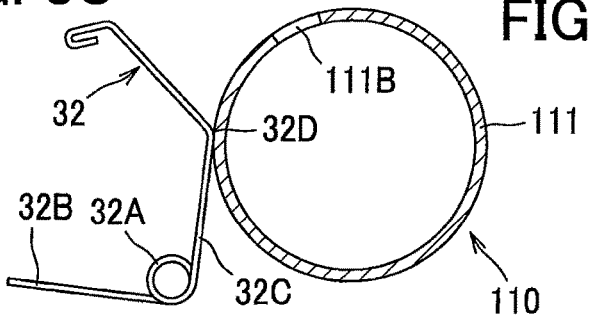
FIG. 8C is a cross-sectional view illustrating relationship between a torsion spring and the carrier in the developing cartridge according to the embodiment, and illustrating a state where the carrier is in the first position.
Figure 8D:
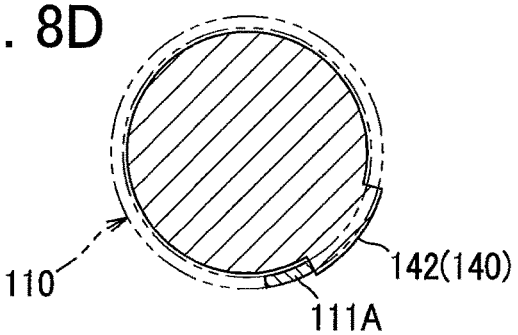
FIG. 8D is a cross-sectional view illustrating relationship between the carrier and the ring gear in the developing cartridge according to the embodiment, and illustrating a state where the carrier is in the first position.
Figure 10A:
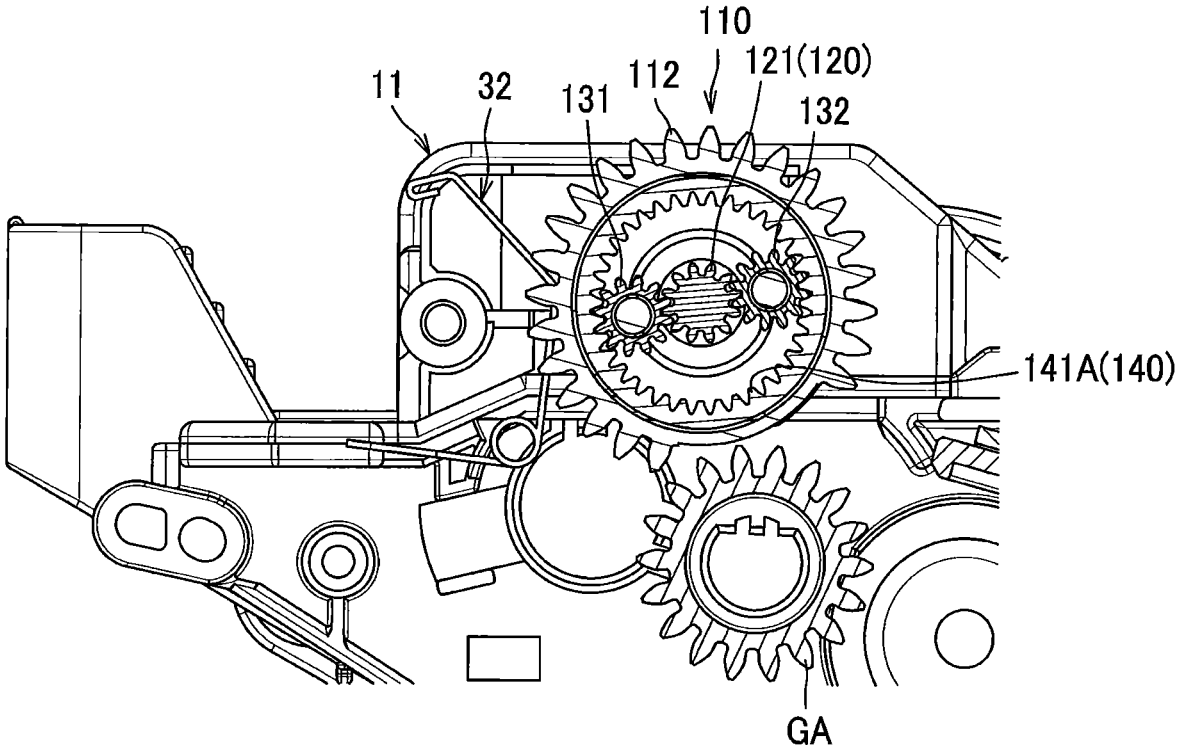
FIG. 10A is a cross-sectional view illustrating the planetary gear mechanism in the developing cartridge according to the embodiment, and illustrating a state where the carrier is in its second position.
Figure 10B:
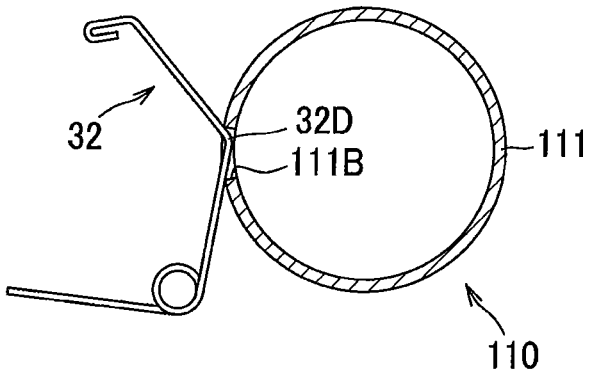
FIG. 10B is cross-sectional view illustrating relationship between the torsion spring and the carrier in the developing cartridge according to the embodiment, and illustrating a state where the carrier is in the second position.

As illustrated in FIG. 8C, the torsion spring 32 includes a coil portion 32A, a first arm 32B, and a second arm 32C. The first arm 32B is fixed to the casing 11. The second arm 32C includes a bending portion 32D that is urged by an outer circumferential surface of the cylindrical portion 111 of the carrier 110. FIGS. 10A and 10B illustrates the second position of the carrier 110 in which the bending portion 32D enters the engagement hole 111B.

Figure 10C:
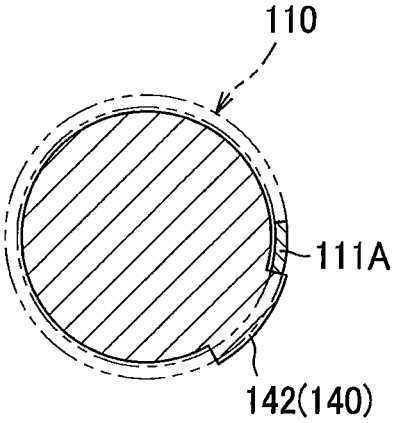
FIG. 10C is a cross-sectional view illustrating relationship between the carrier and the ring gear in the developing cartridge according to the embodiment, and illustrating a state where the carrier is in the second position.

Specifically, the bending portion 32D comes into engagement with the engagement hole 111B immediately before meshing engagement of the plurality of gear teeth 112 with the agitator gear GA is released. With this engagement, the bending portion 32D urges the carrier 110 in the clockwise direction in the drawings. As a result, after the plurality of gear teeth 112 disengages from the agitator gear GA, the carrier 110 moves to its second position due to the urging force of the torsion spring 32. Note that, as illustrated in FIG. 10C, the protrusion 111A of the carrier 110 is in contact with the first protruding portion 142 of the ring gear 140 in a state where the carrier 110 is in the second position.

Next, the first protrusions P11, P12, and P13, the second protrusion P2, and the sensor 7 will be described in detail.

Figure 9A:
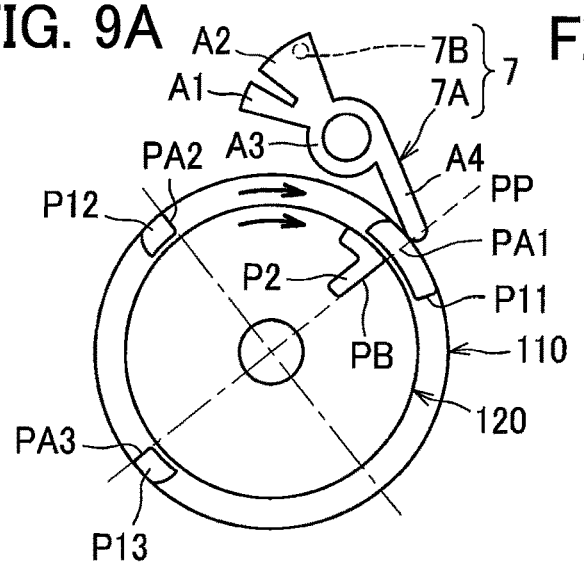
FIGS. 9A to 9F are views illustrating operations of the first protrusions of the carrier and the second protrusion of the sun gear in the developing cartridge according to the embodiment and a lever of the laser printer.

As illustrated in FIG. 9A, the first protrusions P11, P12, and P13 are at positions offset from one another by 90 degrees in the rotational direction of the carrier 110. Specifically, in the present embodiment, the first protrusion P12 has a distal end PA2 in the rotational direction offset from and positioned upstream of a prescribed portion PA1 of the first protrusion P11 in the rotational direction by 90 degrees. The prescribed portion PA1 is a portion positioned between a distal end and a rear end in the rotational direction of the first protrusion P11. Further, the first protrusion P13 has a distal end PA3 in the rotational direction offset from and positioned upstream of the distal end PA2 in the rotational direction by 90 degrees.

In the state illustrated in FIG. 9A, the second protrusion P2 has a distal end PB is at a position the same as the prescribed portion PA1 in the rotational direction of the carrier 110. In other words, both the distal end PB and the prescribed portion PA1 are positioned at a prescribed position PP in the rotational direction of the carrier 110. Here, the prescribed position PP denotes a position in the rotational direction of the carrier 110 and a position where one of the first protrusions P11, P12, and P13, and the second protrusion P2 can support the lever 7A of the sensor 7.

Here, the rotational speed of the sun gear 120 is four times greater than the rotational speed of the carrier 110. Therefore, when the sun gear 120 makes one rotation, the carrier 110 makes one-fourth rotation, i.e., rotates by 90 degrees. Thus, when the sun gear 120 makes one rotation from the state illustrated in FIG. 9A, the carrier 110 rotates by 90 degrees as illustrated in FIG. 9C, thereby positioning both the second protrusion P2 and the first protrusion P12 at the prescribed position PP.

Figure 9B:
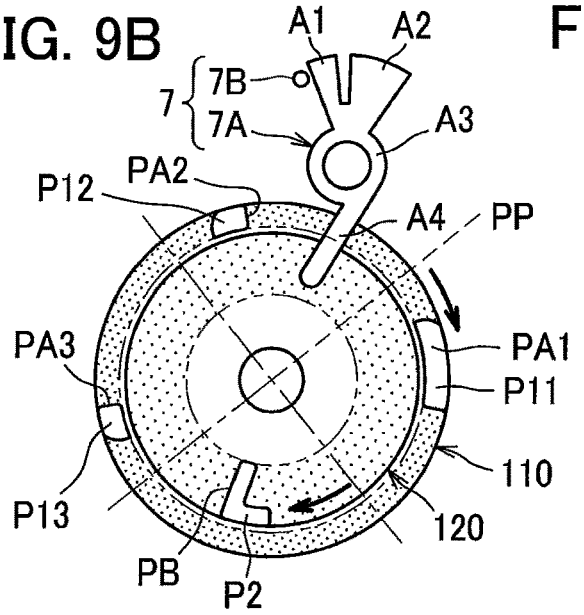
Figure 9C:
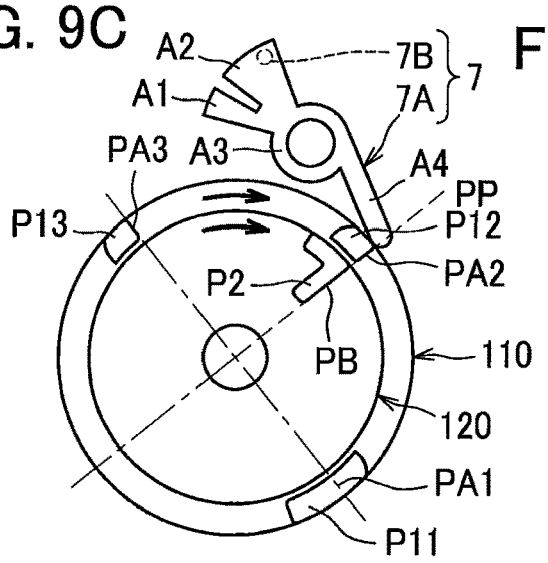
Figure 9D:
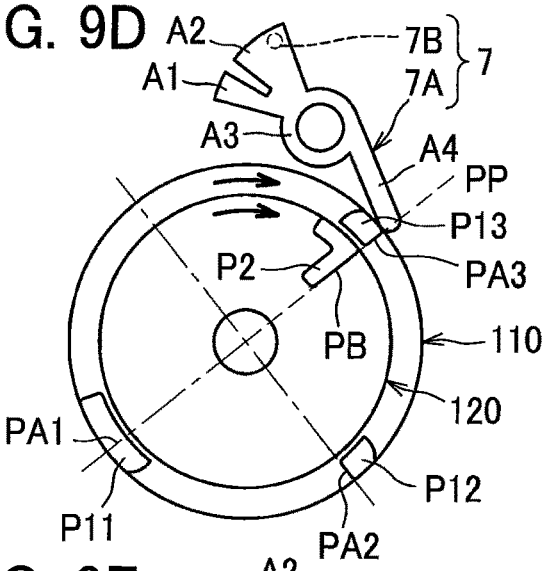
Figure 9E:
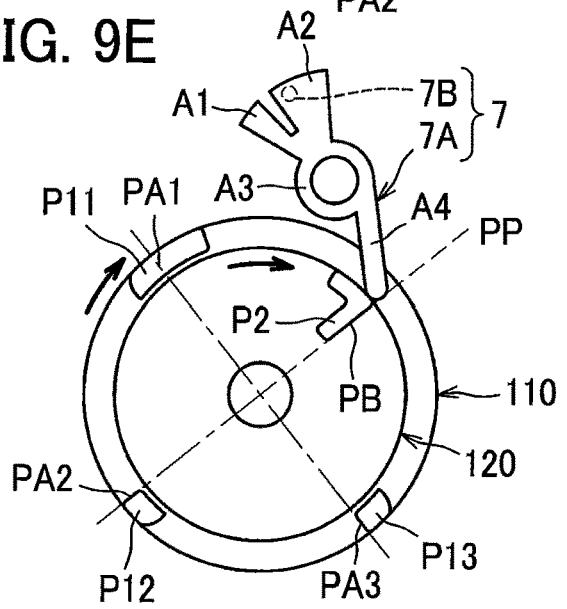
Figure 9F:
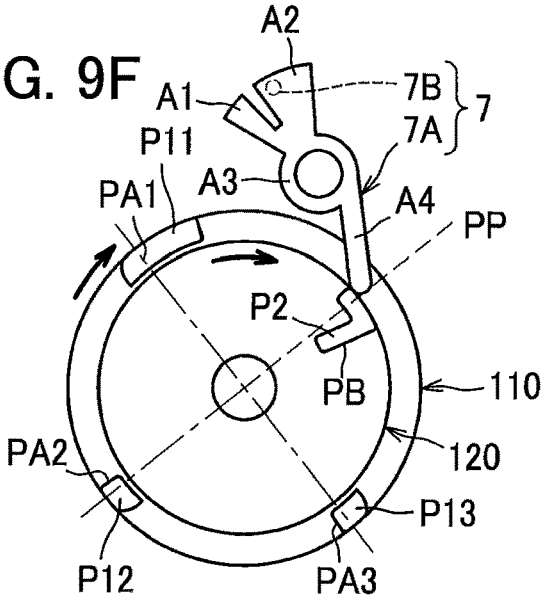

Similarly, when the sun gear 120 makes one rotation from the state illustrated in FIG. 9C, the carrier 110 rotates by 90 degrees as illustrated in FIG. 9D, whereby both the second protrusion P2 and the first protrusion P13 are positioned at the prescribed position PP. Further, when the sun gear 120 further makes one rotation from the state illustrated in FIG. 9D, the carrier 110 rotates by 90 degrees as illustrated in FIG. 9E. At this time, the second protrusion P2 is at the prescribed position PP, while none of the first protrusions P11, P12, and P13 are positioned at the prescribed position PP.

In other words, when the sun gear 120 makes one rotation from a first state of the carrier 110 and the sun gear 120 illustrated in FIG. 9D, the carrier 110 and the sun gear 120 are brought into a second state illustrated in FIG. 9E. When the carrier 110 and the sun gear 120 are in its first state, both the first protrusion P13 and the second protrusion P2 are positioned at the prescribed position PP in the rotational direction of the carrier 110. Further, when the carrier 110 and the sun gear 120 are in its second state, the second protrusion P2 is at the prescribed position PP, whereas the first protrusion P13 is at a position different from the prescribed position PP.

By determining the positions of the first protrusions P11, P12, and P13 and the second protrusion P2 and the rotational speeds of the carrier 110 and the sun gear 120 as described above, the second protrusion P2 can pass through a portion inside the first protrusions P11, P12, and P13 without the necessity of contacting the lever 7A while these first protrusions P11, P12, and P13 support the lever 7A. With the above configuration, a first signal SG1 (see FIG. 11) outputted when the first protrusions P11, P12, and P13 that rotates at a slower rotational speed are in contact with the lever 7A, and a second signal SG2 (see FIG. 11) outputted when the second protrusion P2 that rotates at a faster rotational speed is in contact with the lever 7A can be obtained.

In order to obtain the above first signal SG1 and the second signal SG2, the following conditions must be satisfied: the plurality of first protrusions P11, P12, and P13 are positioned at positions offset from one another by a prescribed angle $\alpha$ in the rotational direction of the carrier 110; the prescribed angle $\alpha$ is $(360/n)\cdot m$ degrees, in which n is a rotational speed ratio of the sun gear 120 to the carrier 110, and both n and m are natural numbers; and the number of the first protrusions P11, P12, and P13 are smaller than n.

In the present embodiment, n=4 and m=1, and the number of the first protrusions P11, P12, and P13 is three. Note that, when the developing cartridge 10 is unused, the carrier 110 is positioned at the first position illustrated in FIG. 8B in the present embodiment. At this time, the first protrusions P11, P12, and P13, and the second protrusion P2 are in a state that rotates from a state in FIG. 9A in a direction opposite to the rotational direction by a prescribed amount. More specifically, as illustrated in FIG. 8A, the first protrusion P11 (i.e., the prescribed portion PA1), which is positioned at the prescribed position PP in the state of FIG. 9A, is in a state that rotates in a counterclockwise direction in the drawings by an angle $\beta$. Further, the second protrusion P2 (i.e., the distal end PB), which is positioned at the prescribed position PP in the state of FIG. 9A, is in a state that rotates in the counterclockwise direction in the drawings by an angle $4\beta$.

That is, when the developing cartridge 10 is unused, a distal end in the rotational direction of the first protrusion P11 is in contact with the lever 7A. Accordingly, when the first protrusion P11 starts to rotate, the first protrusion P11 is in contact with the lever 7A during a period of time longer than a period of time during which the remaining first protrusions P12 and P13 are in contact with the lever 7A, because the outer peripheral surface of the first protrusion P11 has the length greater than lengths of the outer peripheral surfaces of the first protrusions P12 and P13.

The lever 7A includes a first shielding portion A1, a second shielding portion A2, a rotation shaft A3, and an arm portion A4. The first shielding portion A1 and the second shielding portion A2 extend from the rotation shaft A3. The arm portion A4 extends from the rotation shaft A3 toward a direction opposite to a direction in which the first shielding portion A1 and the second shielding portion A2 extend from the rotation shaft A3.

The first shielding portion A1 and the second shielding portion A2 are configured to shield light emitted from the optical sensor 7B. The second shielding portion A2 has a length in a rotational direction of the lever 7A greater than a length of the first shielding portion A1 in the rotational direction of the lever 7A. In addition, the first shielding portion A1 is spaced away from the second shielding portion A2 in the rotational direction of the lever 7A. With this configuration, the light emitted by the optical sensor 7B can pass through a portion between the first shielding portion A1 and the second shielding portion A2.

The lever 7A is movable among a first lever position illustrated in FIG. 9B, a second lever position illustrated in FIG. 9E, and a third lever position illustrated in FIG. 9A. In the first lever position of the lever 7A, the arm portion A4 is positioned on a rotational locus of the first protrusions P11, P12, and P13 and a rotational locus of the second protrusion P2. Further, the lever 7A is urged from the third lever position toward the first lever position by a spring (not illustrated).

The second lever position is a position where the lever 7A make contact with the outer peripheral surface of the second protrusion P2. When the lever 7A is in the second lever position, the light irradiated from the optical sensor 7B is blocked by a portion of the second shielding portion A2 closer to the first shielding portion A1.

The third lever position is a position where the lever 7A contacts the outer peripheral surfaces of the first protrusions P11, P12 and P13. In the third lever position of the lever 7A, the light emitted from the optical sensor 7B is blocked by a portion of the second shielding portion A2 opposite to the first shielding portion A1.

In the present embodiment, the control device CU determines that the sensor 7 is in ON state when the light emitted from the optical sensor 7B is blocked by the lever 7A, and determines that the sensor 7 is in OFF state when the light emitted from the optical sensor 7B is not blocked by the lever 7A. Alternatively, the control device CU may determine that the sensor 7 is in OFF state when the light emitted from the optical sensor 7B is blocked by the lever 7A, and may determine that the sensor 7 is in ON state when the light emitted from the optical sensor 7B is not blocked by the lever 7A.

Next, operations and advantages of the developing cartridge 10 with the above configuration will be described.

As illustrated in FIG. 1, the developing cartridge 10 moves in the third direction such that the developing roller 12 faces the laser printer 1 when the developing cartridge 10 is attached to the laser printer 1.

Further, in the unused state of the developing cartridge 10 illustrated in FIG. 1, i.e., in a state where the carrier 110 is at its first position, the first protrusion P11, which is positioned most upstream in the rotational direction among the first protrusions P11, P12, and P13, is exposed to the outside of the developing cartridge 10 via the opening 31A. Specifically, a portion in the vicinity of the distal end of the first protrusion P11 is positioned at the prescribed position PP described above (see FIG. 8A). Therefore, the first protrusion P11 is in contact with the lever 7A to pivotally move the lever 7A.

As described above, when the optical sensor 7B detects the displacement of the lever 7A, the control device CU determines that a developing cartridge 10 has been attached to the main body housing 2.

When the laser printer 1 starts to be driven in accordance with the control device CU, the agitator gear GA rotates, and the carrier 110 rotates in accordance with the rotation of the agitator gear GA as illustrated in FIG. 8B. As the carrier 110 rotates, the planetary gear 131 and the second planetary gear 132 also rotate. The rotations of the planetary gear 131 and the second planetary gear 132 cause the sun gear 120 to rotate. Specifically, the rotational speed of the sun gear 120 is four times greater than the rotational speed of the carrier 110.

As the carrier 110 and the sun gear 120 rotate, the first protrusions P11, P12, and P13, and the second protrusion P2 rotates in the clockwise direction in the drawings in the sequence FIG. 8A to FIG. 9A. Here, the length of the outer peripheral surface of the first protrusion P11 is greater than the lengths of the outer peripheral surfaces of the first protrusion P12 and the first protrusion P13. With this configuration, the first protrusion P11 is in contact with the lever 7A during the period of time longer than the period of time during which the first protrusion P12 and the first protrusion P13 are in contact with the lever 7A. Therefore, rotation of the first protrusion P11 can maintain the sensor 7 in the ON state during a period of time T1 illustrated in FIG. 11 since the agitator gear GA starts to be driven (time T0).

In a case where the sensor 7 is in the ON state at a time when the agitator gear GA starts to be driven, the control device CU determines that the developing cartridge 10 is attached to the main body housing 2.

As illustrated in FIG. 9A, the second protrusion P2 passes through the portion inside the first protrusion P11 while the first protrusion P11 is in contact with the lever 7A.

Figure 11:
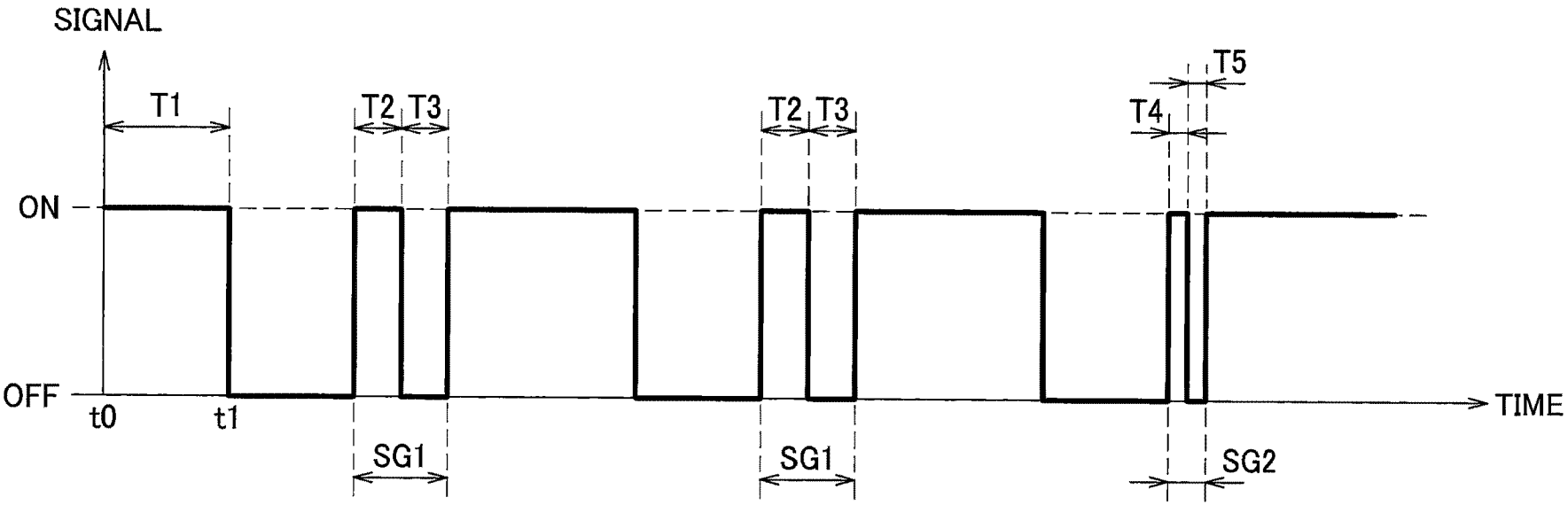
FIG. 11 is a timing chart illustrating signals outputted from a sensor of the laser printer.

As illustrated in FIG. 9B, when the first protrusion P11 becomes out of contact with the lever 7A, the lever 7A moves toward the first lever position due to an urging force of the spring (not illustrated). Since the lever 7A is moved to be offset from the optical path of the light emitted from the optical sensor 7B, the sensor 7 is changed to the OFF state (time T1) as illustrated in FIG. 11. Note that, when the lever 7A moves from the third lever position illustrated in FIG. 9A to the first lever position illustrated in FIG. 9B, the light emitted from the optical sensor 7B passes through a position between the first shielding portion A1 and the second shielding portion A2 for an instant. However, since the lever 7A moves due to the urging force of the spring at a fast speed, the control device CU does not determine that the sensor 7 is changed to the OFF state.

As illustrated in the sequence FIGS. 9B and 9C, the first protrusion P12 contacts the lever 7A in the first lever position before the second protrusion P2 contacts the lever 7A. Thus, the first protrusion P12, which moves at a speed slower than the second protrusion P2, moves the lever 7A from the first lever position to the third lever position at a first speed. As the lever 7A moves at the first speed, a slit between the first shielding portion A1 and the second shielding portion A2 of the lever 7A passes through a portion between the light-emitting portion and the light-receiving portion of the optical sensor 7B at the first speed. Accordingly, the first signal SG1 in which the ON-time is a period of time T2 and the OFF-time is a period of time T3 can be obtained.

As the first protrusion P12 separates from the lever 7A, the lever 7A moves back to the first lever position due to the urging force of the spring (illustration omitted). Then, as illustrated in FIG. 9D, the first protrusion P13 contacts the lever 7A earlier than the second protrusion P2 to move the lever 7A from the first lever position to the third lever position at the first speed. This contact causes the control device CU to obtain the secondary first signal SG1 illustrated in FIG. 11.

Then, when the first protrusion P13 becomes out of contact with the lever 7A, the lever 7A moves back again to the first lever position by the urging force of the spring (not illustrated). Next, as illustrated in FIG. 9E, the second protrusion P2 makes contact with the lever 7A in the first lever position. That is, the second protrusion P2, which rotates at a speed faster than the first protrusions P11, P12, and P13, moves the lever 7A at a second speed faster than the first speed. Since the lever 7A moves at the second speed, the slit between the first shielding portion A1 and the second shielding portion A2 passes through the portion between the light-emitting portion and the light-receiving portion of the optical sensor 7B at the second speed. As a result, the second signal SG2 in which the ON-time is a fourth period of time T4 shorter than the second period of time T2, and the OFF-time is a fifth period of time T5 shorter than the third period of time T3 can be obtained.

The plurality of signal patterns of the combination of the first signal SG1 and the second signal SG2 can be obtained by modifying at least one of the number of the first protrusions P11, P12, and P13, the arrangement of the first protrusions P11, P12, and P13, and the arrangement of the second protrusion P2 with respect to the first protrusions P11, P12, and P13. By correlating in advance the signal pattern with the specification of the developing cartridge 10, the control device CU can identify the specification of the developing cartridge 10.

When each of the first protrusions P11, P12, and P13, and the second protrusion P2 reaches the position illustrated in FIG. 9E, the plurality of gear teeth 112 is out of meshing engagement with the agitator gear GA as illustrated in FIG. 10A. At this time, as illustrated in FIG. 10B, the bending portion 32D of the torsion spring 32 engages with the engagement hole 111B of the carrier 110 to rotate the carrier 110 by the urging force of the torsion spring 32. Accordingly, the first protrusions P11, P12, and P13, and the second protrusion P2 slightly rotate in the sequence FIG. 9E to FIG. 9F, and the carrier 110 stops its rotation at the second position.

Note that, when the carrier 110 is in the second position, the second protrusion P2 supports the lever 7A. With this configuration, when the developing cartridge 10 being used is detached from the main body housing 2 and is attached to the main body housing 2 again, the second protrusion P2 presses the lever 7A, whereby the control device CU can determine that the developing cartridge 10 is attached to the main body housing 2.

In the developing cartridge according to the embodiment, the following advantages can be obtained.

By using the planetary gear mechanism 100, the rotational speed of the first protrusions P11, P12, and P13 configured to contact the lever 7A can be made different from the rotational speed of and the second protrusion P2 configured to contact the lever 7A. Accordingly, the signal pattern of the combination of the first signal SG1 and the second signal SG2 according to the specification of the developing cartridge 10 can be made. Consequently, a developing cartridge 10 that has a new structure for identifying the specification of the developing cartridge 10 can be provided.

Further, upon input of the driving force to the carrier 110, the sun gear 120 rotates at the rotational speed faster than the carrier 110. With this configuration, the speed difference between the first protrusions P11, P12, and P13, and the second protrusion P2 can be readily obtained.

While the description has been made in detail with reference to the specific embodiment, it would be apparent to those skilled in the art that many modifications and variations may be made thereto without departing from the scope of the disclosure. Next, various modifications to the embodiment will be described wherein like parts and components are designated with the same reference numerals as those shown in the embodiment to avoid duplicating description.

In the embodiment described above, n=4 and m=1, and the number of the first protrusions P11, P12, and P13 is three in order to obtain the first signal SG1 and the second signal SG2. However, the present disclosure is not limited to this. For example, in a first modification illustrated in FIGS. 12A to 12D, n=4 and m=2, and the number of the first protrusions is two. That is, the prescribed angle α described above is 180 degrees in the first modification.

In this first modification, when the second protrusion P2 makes one rotation from a state of FIG. 12 A in which both the first protrusion P11 and the second protrusion P2 are at the prescribed position PP, the second protrusion P2 is at the prescribed position PP while the first protrusion P11 and the first protrusion P13 are at positions offset from the prescribed position PP by 90 degrees, as illustrated in FIG. 12B.

Then, when the second protrusion P2 further makes one rotation from the state illustrated in FIG. 12B, both the first protrusion P13 and the second protrusion P2 are at the prescribed position PP as illustrated in FIG. 12C. As the second protrusion P2 still further makes one rotation from the state of FIG. 12C, the second protrusion P2 is at the prescribed position PP while the first protrusion P11 and the first protrusion P13 are at positions offset from the prescribed position PP by 90 degrees, as illustrated in FIG. 12D.

According to the first modification, the first signal SG1 and the second signal SG2 can be obtained in the sequence the second signal SG2, the first signal SG1, and the second signal SG2, as illustrated in FIG. 12E.

Alternatively, n=3 and m=1, and the number of the first protrusions may be two as illustrated in a second modification in FIG. 13 A to 13C. In this case, the rotational speed of the sun gear 120 is three times faster than the rotational speed of the carrier 110, and the above prescribed angle α is 120 degrees.

Figure 13A:
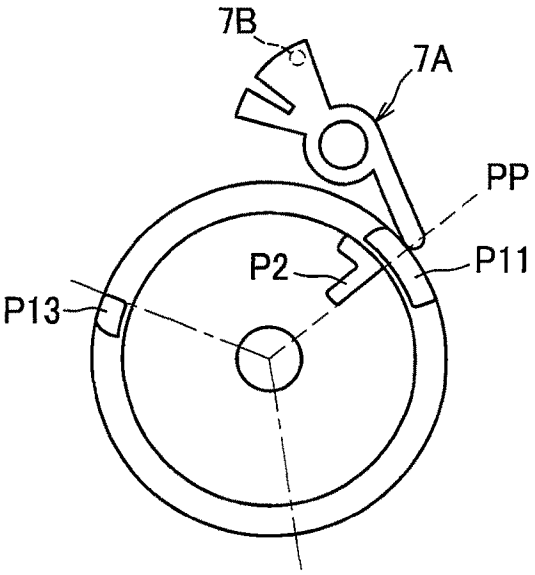
FIGS. 13A to 13C are views illustrating operations of first protrusions of a carrier and a second protrusion of a sun gear in a developing cartridge according to a second modification and the lever of the laser printer.
Figure 13B:
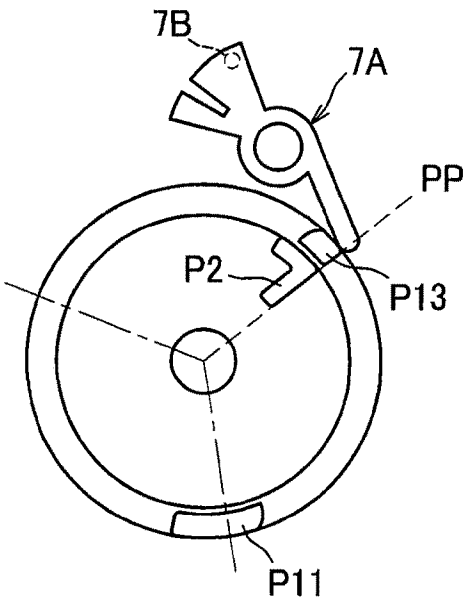
Figure 13C:
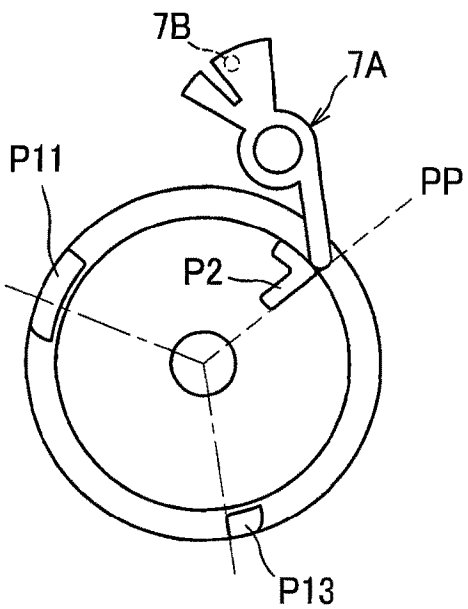

FIG. 13A shows a state where both the first protrusion P11 and the second protrusion P2 are at the prescribed position PP. When the second protrusion P2 makes one rotation from the state of FIG. 13A, both the first protrusion P13 and the second protrusion P2 are at the prescribed position PP, as illustrated in FIG. 13B. Then, when the second protrusion P2 makes further one rotation from the state of FIG. 13B, the second protrusion P2 is at the prescribed position PP, while the two first protrusions P11 and P13 are positioned at positions offset from the prescribed position PP by 120 degrees as illustrated in FIG. 13C.

Figure 13D:
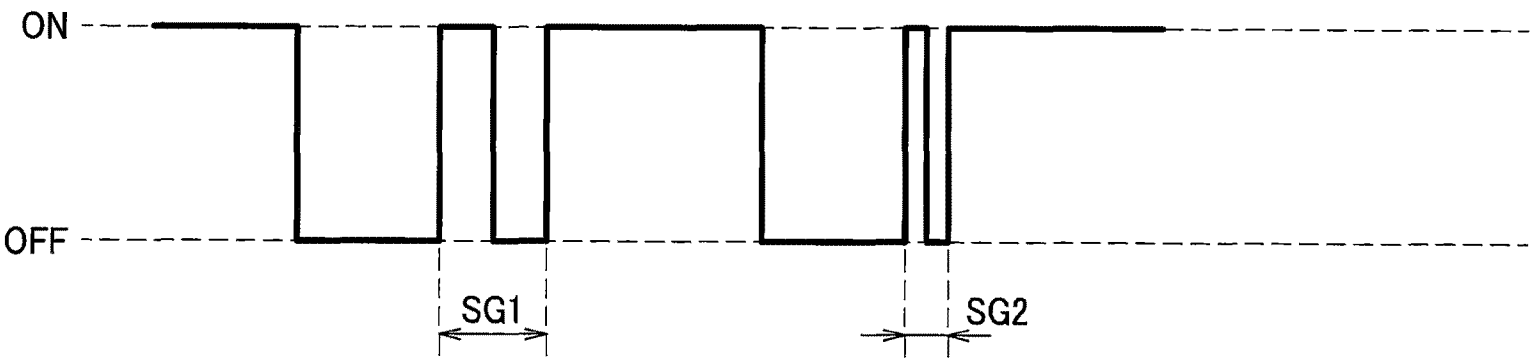
FIG. 13D is a timing chart illustrating signals outputted from the sensor of the laser printer.

According to the second modification, as illustrated in FIG. 13D, the first signal SG1 and the second signal SG2 can be obtained in the sequence the first signal SG1 to the second signal SG2.

Figure 14A:
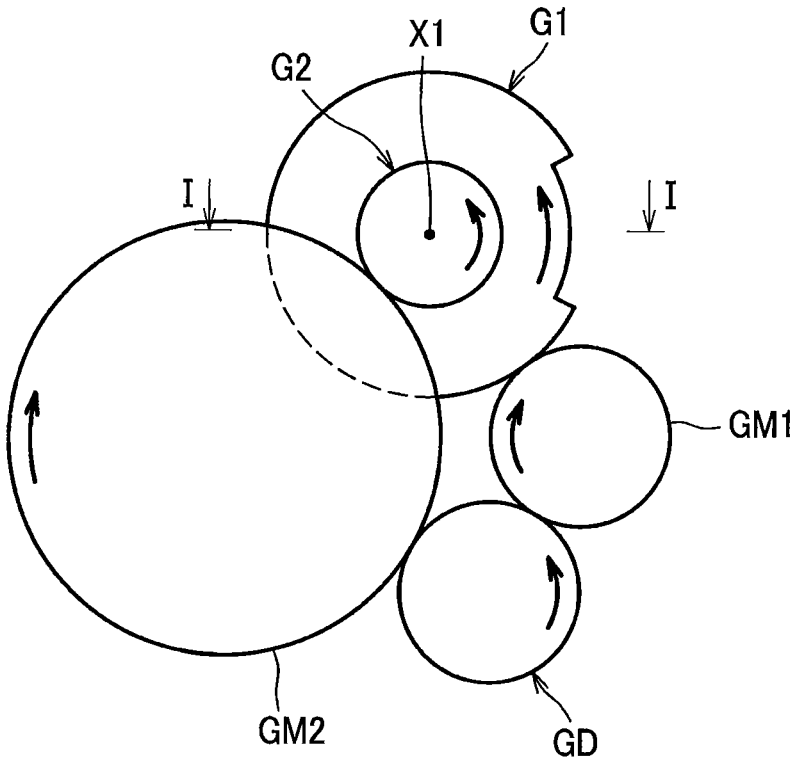
FIG. 14A is a plan view illustrating a first gear and a second gear of a developing cartridge according to a third modification.

In the above embodiment, the speed difference between the first gear and the second gear is obtained by functioning the carrier 110 as the first gear and the sun gear 120 as the second gear. However, another configuration may be employed. For example, the speed difference between the first gear and the second gear may be obtained by employing the first gear and the second gear whose diameters are different from each other. In a third modification illustrated in FIGS. 14A and 14B, a first gear G1 and a second gear G2 have diameters different from each other.

Specifically, the first gear G1 according to the third modification has gear teeth at a portion of a periphery of the first gear G1. The first gear G1 is rotatable about a first axis X1.

The second gear G2 is a gear whose diameter is smaller than the diameter of the first gear G1. The second gear G2 is rotatable about the first axis X1.

A drive gear GD is a gear into which a driving force is inputted. The drive gear GD is in meshing engagement with both a first intermediate gear GM1 and a second intermediate gear GM2.

The first intermediate gear GM1 is in meshing engagement with the first gear G1, and the second intermediate gear GM2 is in meshing engagement with the second gear G2.

According to the third modification, a gear ratio of the second gear G2 relative to the drive gear GD (D2/Dd) is smaller than a gear ratio of the first gear G1 relative to the drive gear GD (D1/Dd). Here, Dd denotes a diameter of a pitch circle of the drive gear GD; D1 denotes a diameter of a pitch circle of the first gear G1; and D2 denotes a diameter of a pitch circle of the second gear G2. Thus, a rotational speed of the second gear G2 is faster than a rotational speed of the first gear G1.

Figure 14B:
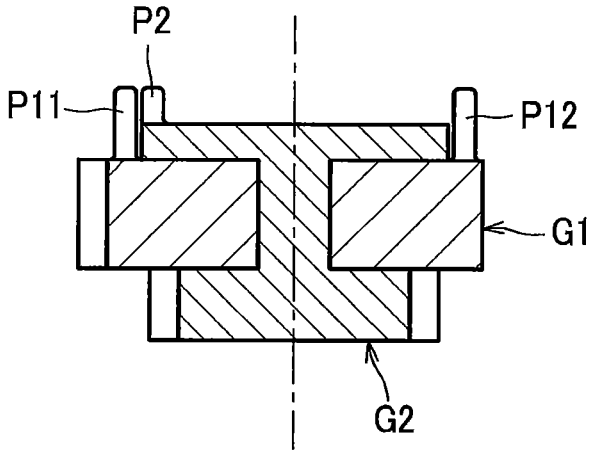
FIG. 14B is a cross-sectional view of FIG. 14A taken along a line I-I.

As illustrated in FIG. 14B, the first gear G1 includes two first protrusions P11 and P12. The second gear G2 includes a second protrusion P2. Upon input of the driving power to the drive gear GD, the second protrusion P2 rotates at a rotational speed greater than a rotational speed of the first protrusions P11 and P12.

Even in the third modification, the rotational speed of the first protrusions P11 and P12 can be made different from the rotational speed of the second protrusion P2. Accordingly, the first signal SG1 and the second signal SG2 can be readily obtained.

While the developing cartridge 10 is separately formed from the photosensitive cartridge 5 in the above embodiment, the developing cartridge 10 may be integrally formed with the photosensitive cartridge 5.

The present disclosure is applied to the laser printer 1 in the present embodiment, but is not limited to this. That is, the present disclosure may be applied to other types of image forming apparatus such as copying machine or multifunction peripheral.

In the embodiment described above, the agitator gear GA serves as an example of the drive gear. However, any type of gears can be employed as the drive gear provided that the gear can transmit driving power to the first gear and the second gear.

While the first axis X1 and the second axis X2 are coincident with each other in the above-described embodiment, the first axis X1 and the second axis X2 may be different from each other.

The elements in the embodiment and modifications thereof may be arbitrarily combined to be implemented.

What is claimed is:

1. A developing cartridge comprising:

a casing configured to accommodate developing agent therein;

a drive gear;

a first gear configured to receive a driving force from the drive gear, the first gear being rotatable about a first axis extending in an axial direction in accordance with rotation of the drive gear, the first gear including a first protrusion; and a second gear configured to receive the driving force from the drive gear, the second gear being rotatable about the first axis, the second gear including a second protrusion, wherein a rotational locus of the second protrusion is positioned inside a rotational locus of the first protrusion, wherein a rotational speed of the second gear is faster than a rotational speed of the first gear, wherein the first gear and the second gear have a first state and a second state, the first gear and the second gear in the first state being brought into the second state due to one rotation of the second gear, wherein, in the first state of the first gear and the second gear, both the first protrusion and the second protrusion are positioned at a prescribed position in a rotational direction of the first gear, and wherein, in the second state of the first gear and the second gear, the second protrusion is positioned at the prescribed position and the first protrusion is positioned at a position different from the prescribed position.

2. The developing cartridge according to claim 1, further comprising a planetary gear mechanism including:

a carrier;

a ring gear fixed to the casing, the ring gear having an internal tooth;

a planetary gear in meshing engagement with the internal tooth of the ring gear, the planetary gear being rotatable relative to the ring gear in accordance with rotation of the carrier; and a sun gear in meshing engagement with the planetary gear and rotatable in accordance with rotation of the planetary gear;

wherein the first gear is the carrier, and wherein the second gear is the sun gear.

3. The developing cartridge according to claim 1, wherein the first protrusion and the second protrusion extend in the axial direction.

4. The developing cartridge according to claim 1, wherein the drive gear, the first gear, and the second gear are rotatably supported by the casing.

5. The developing cartridge according to claim 2, wherein the first gear includes:

a first disc portion; and a shaft protruding from the first disc portion in the axial direction and rotatably supporting the planetary gear, the first protrusion protruding from an outer periphery of the first disc portion in the axial direction, wherein the second gear has a second disc portion, the second protrusion protruding from an outer periphery of the second disc portion in the axial direction.

6. A developing cartridge comprising:

a casing configured to accommodate developing agent therein;

a drive gear;

a first gear configured to receive a driving force from the drive gear, the first gear being rotatable about a first axis extending in an axial direction in accordance with rotation of the drive gear, the first gear including a first protrusion; and a second gear configured to receive the driving force from the drive gear, the second gear being rotatable about the first axis, the second gear including a second protrusion, wherein the first gear includes a plurality of the first protrusions having at least one pair of the first protrusions, the at least one pair of the first protrusions being positioned offset from each other by a prescribed angle in a rotational direction of the first gear, wherein the rotational speed of the second gear is n times faster than the rotational speed of the first gear, wherein a rotational locus of the second protrusion is positioned inside a rotational locus of the first protrusion, wherein the prescribed angle is $(360/n)\cdot m$ degrees in which n and m are natural numbers, and wherein the number of the plurality of the first protrusions is smaller than n.

7. The developing cartridge according to claim 6, wherein $n=4$ and $m=1$, and wherein the number of the plurality of the first protrusions is three.

8. A developing cartridge comprising:

a casing configured to accommodate developing agent therein;

a drive gear;

an agitator configured to agitate the developing agent accommodated in the casing, wherein the drive gear is an agitator gear rotatable together with the agitator;

a first gear configured to receive a driving force from the drive gear, the first gear being rotatable about a first axis extending in an axial direction in accordance with rotation of the drive gear, the first gear including a first protrusion; and a second gear configured to receive the driving force from the drive gear, the second gear being rotatable about the first axis, the second gear including a second protrusion, wherein a rotational speed of the second gear is faster than a rotational speed of the first gear.

9. A developing cartridge comprising:

a casing configured to accommodate developing agent therein;

a drive gear;

a first gear configured to receive a driving force from the drive gear, the first gear being rotatable about a first axis extending in an axial direction in accordance with rotation of the drive gear, the first gear including a first protrusion, wherein the first gear has a plurality of gear teeth positioned at a portion of a periphery of the first gear, at least one of the plurality of gear teeth meshingly engaging with the drive gear; and a second gear configured to receive the driving force from the drive gear, the second gear being rotatable about the first axis, the second gear including a second protrusion, wherein a rotational speed of the second gear is faster than a rotational speed of the first gear.

10. The developing cartridge according to claim 9, wherein the first gear is rotatable from a first position to a second position, wherein, when the first gear is at the first position, at least one of the plurality of gear teeth is in meshing engagement with the drive gear, and wherein, when the first gear is at the second position, none of the plurality of gear teeth is in meshing engagement with the drive gear.

11. A developing cartridge comprising:

a casing configured to accommodate developing agent therein;

a drive gear; and a planetary gear mechanism including:

a ring gear fixed to the casing, the ring gear having an internal tooth;

a carrier meshingly engaging with the drive gear and rotatable relative to the ring gear in accordance with rotation of the drive gear, the carrier including a first protrusion;

a planetary gear in meshing engagement with the internal tooth of the ring gear and rotatable relative to the ring gear in accordance with rotation of the carrier; and a sun gear in meshing engagement with the planetary gear and rotatable in accordance with rotation of the planetary gear, the sun gear including a second protrusion, wherein a rotational speed of the sun gear is faster than a rotational speed of the carrier.

12. The developing cartridge according to claim 11, wherein the carrier covers an outer circumferential surface of the ring gear and is rotatable relative to the outer circumferential surface of the ring gear.

13. The developing cartridge according to claim 11, further comprising a second planetary gear in meshing engagement with the internal tooth of the ring gear and rotatable relative to the ring gear in accordance with the rotation of the carrier, and wherein the sun gear is positioned between the planetary gear and the second planetary gear.

14. The developing cartridge according to claim 11, further comprising a second planetary gear in meshing engagement with the internal tooth of the ring gear and rotatable relative to the ring gear in accordance with the rotation of the carrier, wherein the sun gear is positioned between the planetary gear and the second planetary gear, and wherein the carrier covers an outer circumferential surface of the ring gear and is rotatable relative to the outer circumferential surface of the ring gear.

15. The developing cartridge according to claim 11, wherein the carrier has a plurality of gear teeth positioned at a portion of a periphery of the carrier, at least one of the plurality of gear teeth meshingly engaging with the drive gear.

16. The developing cartridge according to claim 15, wherein the carrier is rotatable from a first position to a second position, wherein, when the carrier is at the first position, at least one of the plurality of gear teeth is in meshing engagement with the drive gear, and wherein, when the carrier is at the second position, none of the plurality of gear teeth is in meshing engagement with the drive gear.

* * * * *